US005352048A

United States Patent [19]

Mizoguchi et al.

[11] Patent Number: 5,352,048

[45] Date of Patent: Oct. 4, 1994

[54] INK SHEET CASSETTE AND RECORDING APPARATUS CAPABLE OF LOADING THE INK SHEET CASSETTE

[75] Inventors: Yoshiyuki Mizoguchi; Yoshitaka Watanabe, both of Kawasaki, Japan

[73] Assignee: Canon Kabushiki Kaisha, Tokyo, Japan

[21] Appl. No.: 39,691

[22] Filed: Mar. 29, 1993

Related U.S. Application Data

[63] Continuation of Ser. No. 885,012, May 19, 1992, abandoned, which is a continuation of Ser. No. 454,684, Dec. 21, 1989, abandoned.

[30] Foreign Application Priority Data

Dec. 23, 1988 [JP] Japan ..... 63-323560
Dec. 23, 1988 [JP] Japan ..... 63-323562

[51] Int. Cl.[5] ..... B41J 35/28
[52] U.S. Cl. ..... 400/208; 400/207
[58] Field of Search ..... 400/194, 207, 208, 208.1, 400/242, 642

[56] References Cited

U.S. PATENT DOCUMENTS

| | | | |
|---|---|---|---|
| 4,160,605 | 7/1979 | Neubaum | 400/208 |
| 4,622,563 | 11/1986 | Watanabe | 400/208 |
| 4,673,304 | 6/1987 | Liu et al. | 400/208 |
| 4,676,678 | 6/1987 | Watanabe | 400/208 |
| 4,687,358 | 8/1987 | Saitou | 400/208 |
| 4,698,650 | 10/1987 | Watanabe et al. | 346/134 |
| 4,750,007 | 6/1987 | Suzuki | 346/76 PH |
| 4,760,405 | 7/1988 | Nagira et al. | 346/1.1 |
| 4,778,290 | 10/1988 | Casta et al. | 400/208 |
| 4,828,412 | 5/1989 | Palmlund | 400/208 |
| 4,844,636 | 7/1989 | Pague | 400/208 |
| 4,884,909 | 12/1989 | Watanabe et al. | 400/625 |
| 4,888,602 | 12/1989 | Watanabe et al. | 346/134 |
| 4,892,425 | 1/1990 | Shimizu et al. | 400/208 |
| 4,899,171 | 2/1990 | Ogura et al. | 346/76 PH |
| 4,915,516 | 4/1990 | Shimizu et al. | 400/208 |
| 4,924,242 | 5/1990 | Fukawa | 400/208 |
| 4,944,619 | 7/1990 | Suzuki et al. | 400/208 |
| 4,955,738 | 9/1990 | Uchikata | 400/208 |
| 4,970,531 | 11/1990 | Shimizu et al. | 400/208 |
| 4,973,983 | 11/1990 | Yamamoto et al. | 400/208 |

FOREIGN PATENT DOCUMENTS

| | | | |
|---|---|---|---|
| 60-27579 | 2/1985 | Japan . | |
| 16878 | 1/1986 | Japan | 400/208 |
| 31270 | 2/1986 | Japan | 400/208 |
| 53072 | 3/1986 | Japan | 400/208 |
| 222772 | 10/1986 | Japan | 400/208 |
| 115771 | 11/1986 | Japan | 400/208 |
| 116879 | 11/1986 | Japan | 400/208 |
| 211174 | 9/1987 | Japan | 400/208 |
| 275766 | 11/1987 | Japan | 400/208 |
| 115770 | 5/1988 | Japan | 400/208 |
| 170058 | 7/1988 | Japan | 400/208 |

*Primary Examiner*—David A. Wiecking
*Attorney, Agent, or Firm*—Fitzpatrick, Cella, Harper & Scinto

[57] ABSTRACT

An ink sheet cassette of reduced size and a recording apparatus for loading the ink sheet cassette therein are provided. The ink sheet cassette includes an ink sheet, a first reel capable of winding the ink sheet around itself, a second reel capable of winding the ink sheet around itself, and a frame holding the first reel and the second reel, bent orthogonally with respect to an ink layer surface on the ink sheet. The recording apparatus includes a loading portion capable of loading the above ink sheet cassette therein, a recording head capable of recording from the ink sheet in the ink sheet cassette loaded in the loading portion to thereby record an image on a recording medium and feed means for feeding the recording medium. The frame of the ink sheet cassette also has a guide portion to guide feeding of a recording medium when the ink sheet cassette is loaded in the recording apparatus.

32 Claims, 26 Drawing Sheets

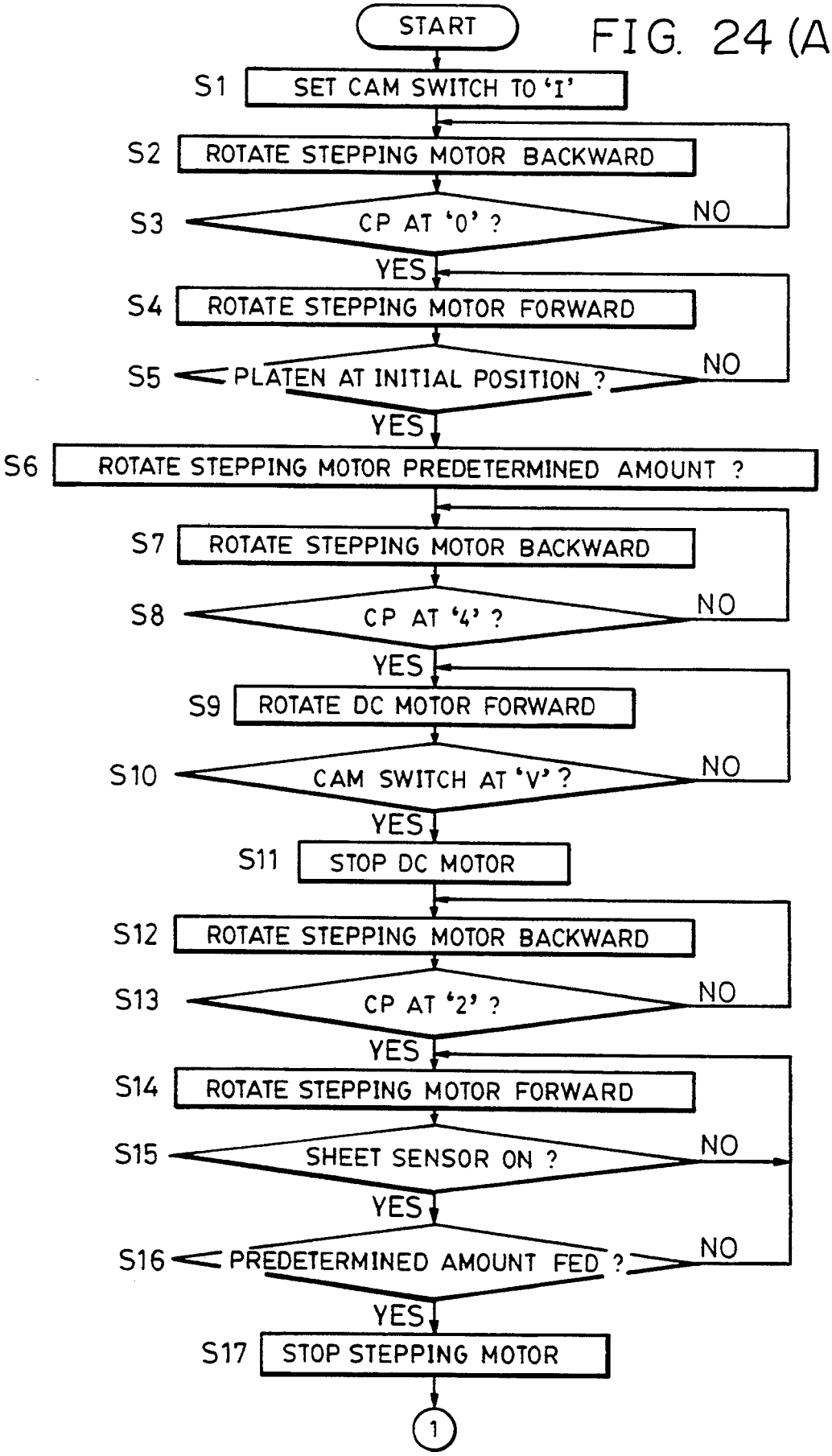
START
FIG. 24 (A)
S1
SET CAM SWITCH TO 'I'
S2
ROTATE STEPPING MOTOR BACKWARD
S3
CP AT '0' ?
NO
YES
S4
ROTATE STEPPING MOTOR FORWARD
S5
PLATEN AT INITIAL POSITION ?
NO
YES
S6
ROTATE STEPPING MOTOR PREDETERMINED AMOUNT ?
S7
ROTATE STEPPING MOTOR BACKWARD
S8
CP AT '4' ?
NO
YES
S9
ROTATE DC MOTOR FORWARD
S10
CAM SWITCH AT 'V' ?
NO
YES
S11
STOP DC MOTOR
S12
ROTATE STEPPING MOTOR BACKWARD
S13
CP AT '2' ?
NO
YES
S14
ROTATE STEPPING MOTOR FORWARD
S15
SHEET SENSOR ON ?
NO
YES
S16
PREDETERMINED AMOUNT FED ?
NO
YES
S17
STOP STEPPING MOTOR
1

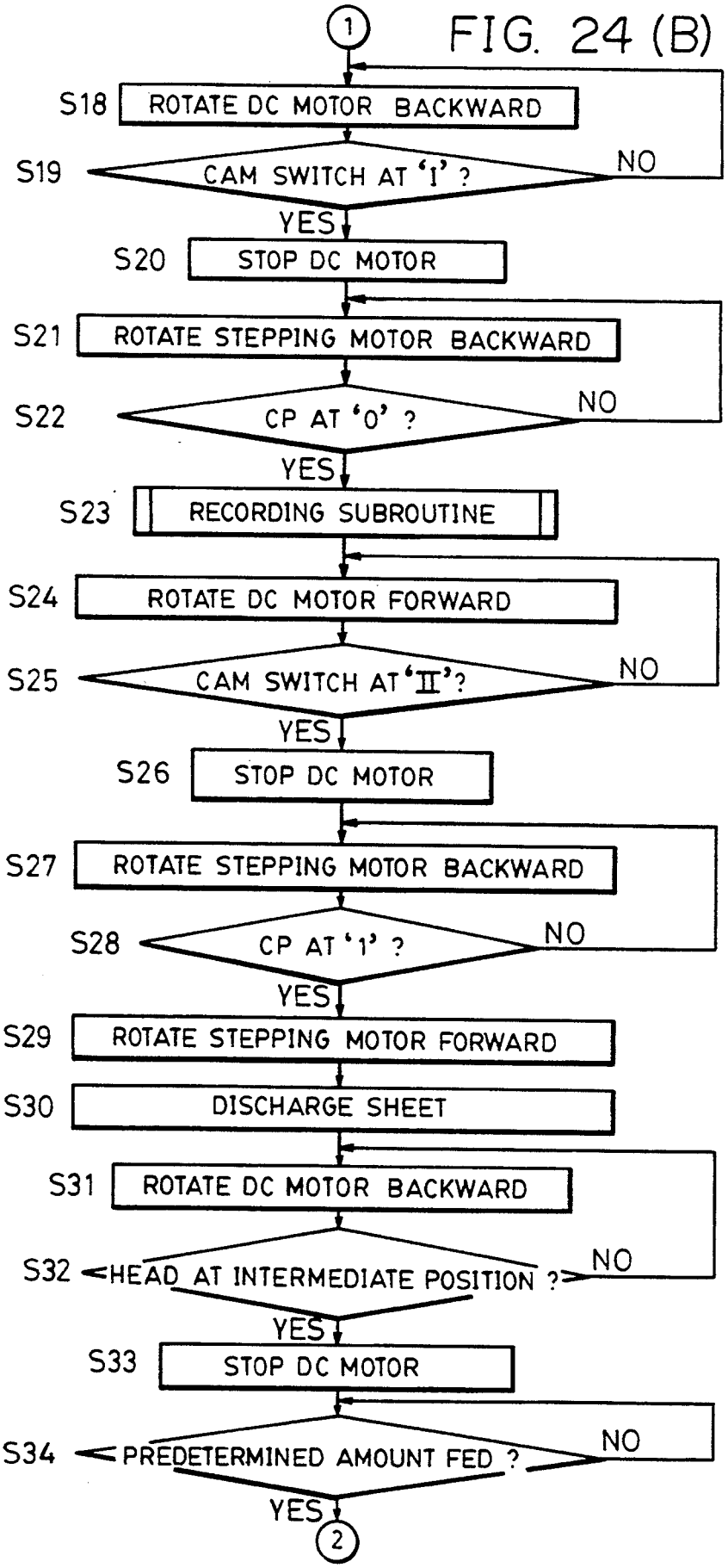
1
FIG. 24 (B)
S18
ROTATE DC MOTOR BACKWARD
S19
CAM SWITCH AT 'I' ?
NO
YES
S20
STOP DC MOTOR
S21
ROTATE STEPPING MOTOR BACKWARD
S22
CP AT '0' ?
NO
YES
S23
RECORDING SUBROUTINE
S24
ROTATE DC MOTOR FORWARD
S25
CAM SWITCH AT 'II'?
NO
YES
S26
STOP DC MOTOR
S27
ROTATE STEPPING MOTOR BACKWARD
S28
CP AT '1' ?
NO
YES
S29
ROTATE STEPPING MOTOR FORWARD
S30
DISCHARGE SHEET
S31
ROTATE DC MOTOR BACKWARD
S32
HEAD AT INTERMEDIATE POSITION ?
NO
YES
S33
STOP DC MOTOR
S34
PREDETERMINED AMOUNT FED ?
NO
YES
2

INK SHEET CASSETTE AND RECORDING APPARATUS CAPABLE OF LOADING THE INK SHEET CASSETTE

This application is a continuation of application Ser. No. 07/885,012 filed May 19, 1992, now abandoned and which was a continuation of application Ser. No. 07/454,684 filed Dec. 21, 1989, also abandoned.

BACKGROUND OF THE INVENTION

1. Field of the Invention

The present invention relates to an ink sheet cassette for accommodating an ink sheet used in a thermal transfer recording system and a recording apparatus capable of loading the ink sheet cassette therein.

2. Description of the Related Art

Today, various types of recording systems have been developed and put into practice as output units for input information. The thermal transfer recording system is a typical one among such recording systems.

In the thermal transfer recording system, a heat-fusible ink sheet is placed over a recording sheet and the ink sheet is heated by a recording head in the form of an image pattern. The melted ink is transferred to the recording sheet so that an image is recorded.

Apparatus of the thermal transfer recording type are in wide use owing to ease of handling and lower noise.

Presently, an ink sheet for use in the thermal transfer recording system is accommodated in a cassette and the spent ink sheet is replaced with a new one together with the cassette for easier management and handling of ink sheets.

With conventional ink sheet cassettes, however, since the feed path of an ink sheet from a feed reel to a take-up reel is formed rectilinearly, there arises a problem that the height of the recording apparatus becomes large and the apparatus size is hence increased when attempting to load the ink cassette obliquely.

Meanwhile, the thermal transfer type recording apparatus is required to provide sheet guides along the feed path of recording sheets so that the recording sheets are fed without departing from the feed path. Accordingly, there have been parts needed for mounting the sheet guides and spaces for mounting them. This has also invited problems of increasing the number of parts of the apparatus and preventing further reduction of the apparatus size.

SUMMARY OF THE INVENTION

It is an object of the present invention to provide a recording apparatus which has achieved size reduction, and an ink sheet cassette which can be easily loaded into the recording apparatus.

Another object of the present invention is to provide a recording apparatus which can reduce the number of parts, and an ink sheet cassette which can be easily loaded into the recording apparatus.

Still another object of the present invention is to provide an ink sheet cassette which can be easily loaded into a recording apparatus having the reduced size, and a recording apparatus which can load the ink sheet cassette therein.

Still another object of the present invention is to provide an ink sheet cassette which can reduce the number of parts as well as the required space, by causing the ink sheet cassette to double as a guide member for recording sheets, and a recording apparatus which can load that ink sheet cassette therein.

BRIEF DESCRIPTION OF THE DRAWINGS

FIGS. 14(A) and 14(B) through 19(A) and 19(B) are operational explanatory views of respective components dependent on operation of the rotating cam and the translation cam;

DETAILED DESCRIPTION OF THE PREFERRED EMBODIMENT

Figure 1:
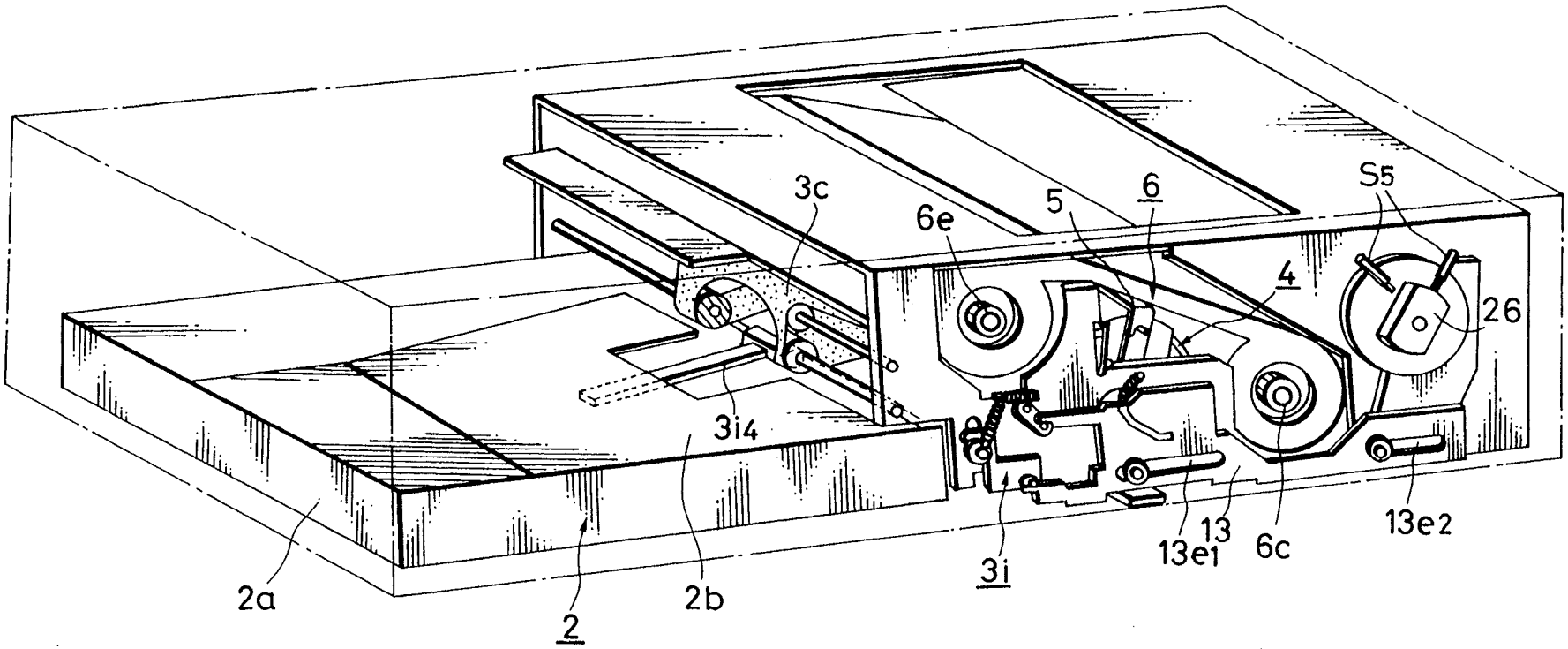
FIG. 1 is an explanatory perspective view of a recording apparatus according to one embodiment of the present invention.

With the embodiment explained below, a bent shape of an ink sheet cassette provides a recording apparatus with a smaller space in the elevational direction when the ink sheet cassette is loaded into the recording apparatus. Also, when heat transfer recording is performed after loading the ink sheet cassette into the recording apparatus, the ink sheet cassette doubles as a sheet guide without requiring a special sheet guide.

Hereinafter, one embodiment of the present invention will be described in connection with a recording apparatus by referring to the drawings.

Figure 2:
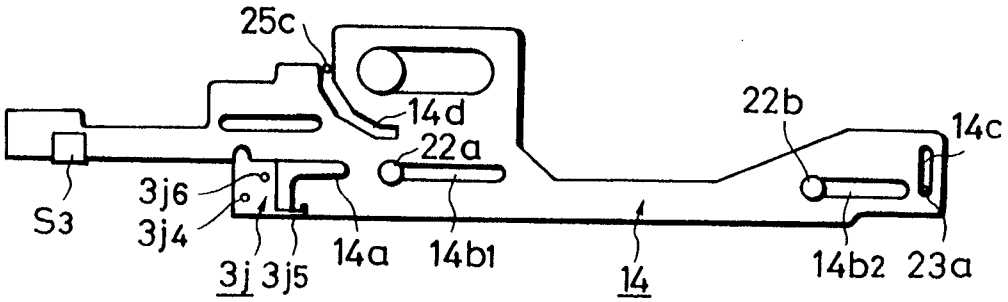
FIGS. 2(A) and 2(B) are explanatory sectional views of the apparatus in a recording state.
Figure 2:
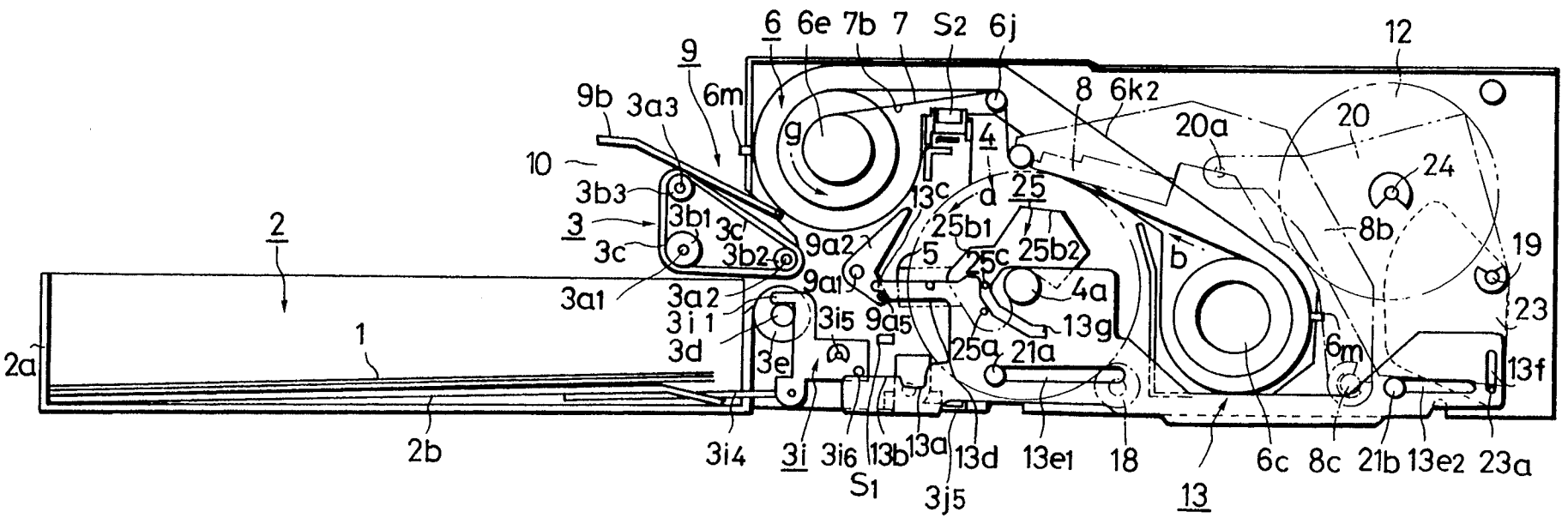
Figure 3:
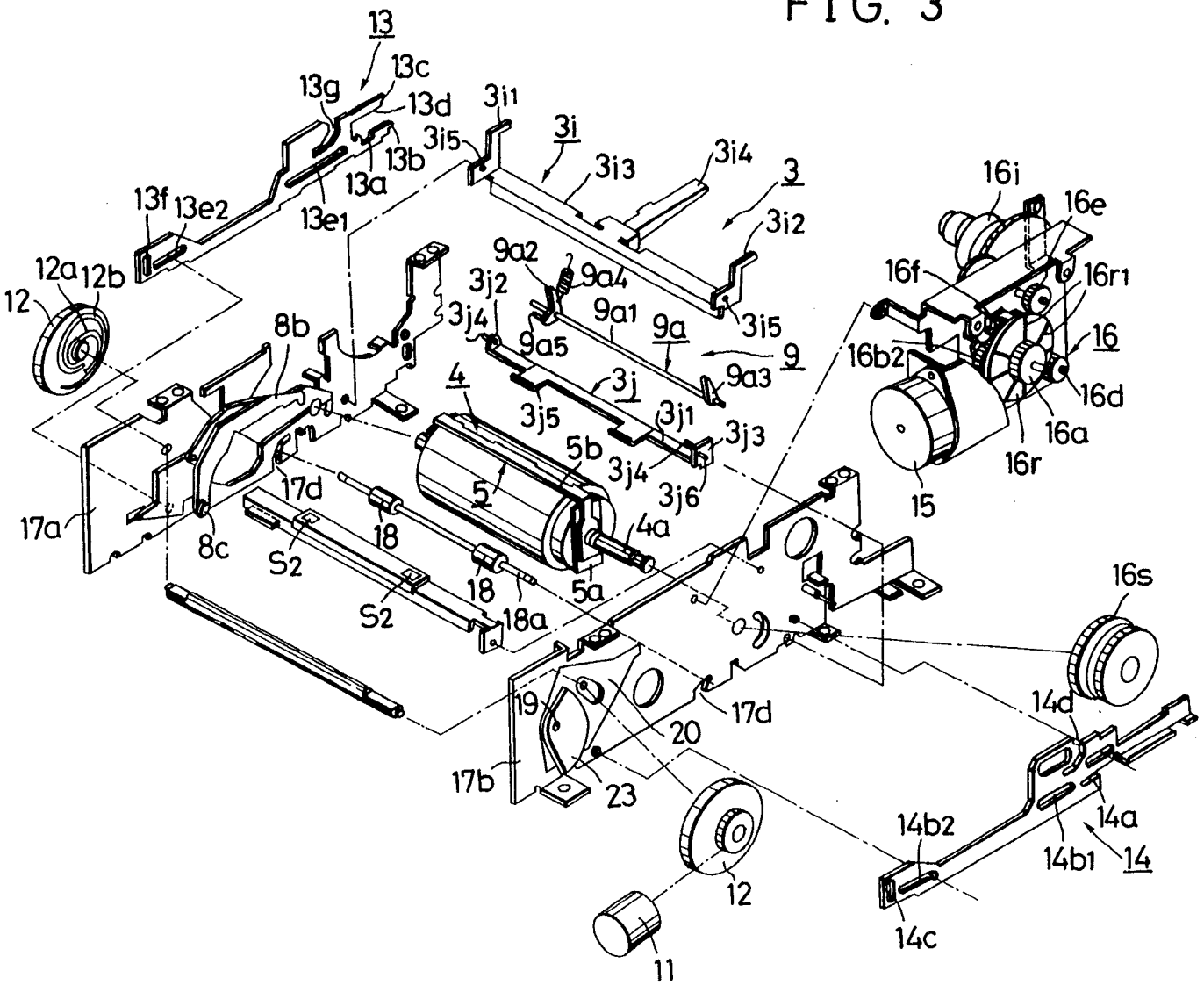
FIG. 3 is an explanatory exploded view of certain parts.

FIG. 1 is an explanatory perspective view of the recording apparatus, FIGS. 2(A) and 2(B) are explanatory sectional views of the apparatus in a recording state, and FIG. 3 is an explanatory exploded view of certain parts.

An outline of the entire apparatus will now be described. A multiplicity of recording sheets 1, shown in FIG. 2(B), for instance, comprising cut sheets are stored in a cassette 2 in a stacked condition for being separated and fed by supply means 3, one by one. The recording sheet 1 thus fed out of the cassette 2 is gripped at its leading edge by a gripper 5 mounted to a platen 4 as feed means, and fed in a direction of arrow a (shown in FIG. 2(B)) as the platen 4 rotates.

When recording, an ink sheet 7 in an ink sheet cassette 6 is fed out in a direction of arrow b in synchronism with rotation of the platen 4, and a recording head 8 having a plurality of heating elements is moved up and down at the proper timing for bringing the ink sheet 7 into pressure contact with the recording sheet 1. At the same time, the recording head is heated in accordance with an image signal, whereby ink on the ink sheet 7 is transferred to the recording sheet 1 for recording.

After recording, the recording sheet 1 is discharged into a discharge section 10 by discharge means 9.

As the rotating cam 12 is rotated by a DC motor, the recording head 8 is moved up and down upon rotation of the rotating cam 12, while a first translation cam 13 and a second translation cam 14 are actuated to operate those components associated with the supply means 3, the gripper 5, the recording head 8, and those components associated with the discharge means 9 correspondingly.

Further, supply and discharge of the recording sheet 1 by the supply means 3 and the discharge means 9, rotation of the platen 4, and take-up of the ink sheet 7 are made by drive power transmitted from a stepping motor 15 (shown in FIG. 3) through clutch means 16.

Construction of the respective components will be described below in detail one by one.

First, the cassette 2 will be described. As shown in FIGS. 1, 2(A) and 2(B), a case 2*a* for storing the recording sheets 1 in a stacked condition is detachably attached to a body of the recording apparatus. A sheet bearing member 2*b* is disposed on the inner bottom surface of the case 2*a*, and the recording sheets 1 are stacked on the sheet bearing member 2*b* for being stored in the cassette 2.

Figure 4:
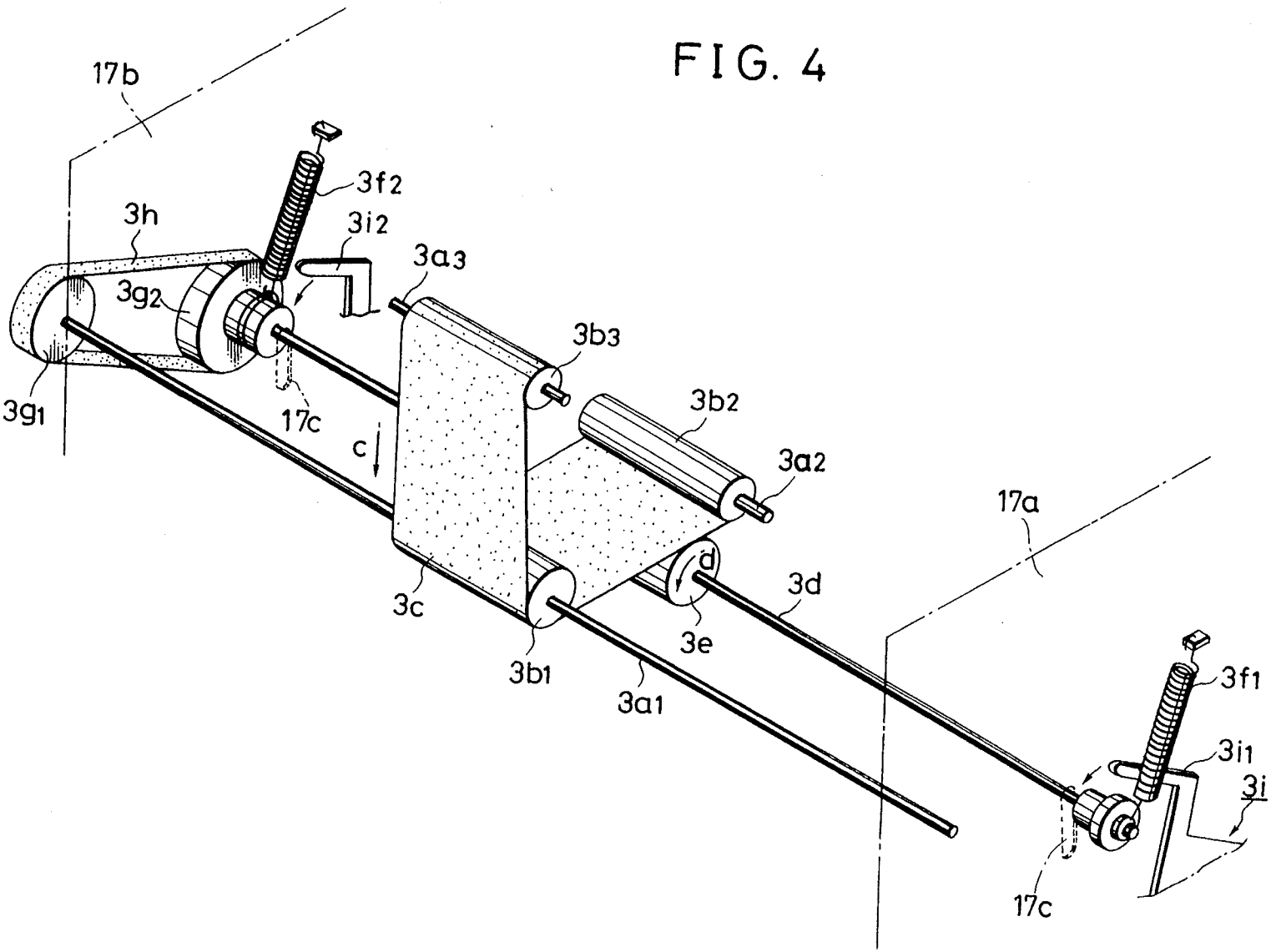
FIG. 4 is an explanatory view showing the arrangement of a feed belt and a separation roller.

Construction of the sheet supply means 3 will now be described with reference to FIGS. 2(B) and 4. As shown in FIGS. 2(B) and 4, three shafts $3a_1$, $3a_2$, $3a_3$ are rotatably supported at their opposite ends to side wall chassis 17*a*, 17*b* of the apparatus, and supply/discharge rollers $3b_1$, $3b_2$, $3b_3$ are fixedly fitted over the three shafts $3a_1$, $3a_2$, $3a_3$ nearly at their centers, respectively, with a supply/discharge belt 3*c* entrained between those supply/discharge rollers. A gear in mesh with a supply/discharge gear (described later) is mounted on the shaft $3a_1$, so that the supply/discharge belt 3*c* is rotated in a direction of arrow c in FIG. 4 by torque transmitted to the gear.

Below the supply/discharge roller $3b_2$, there is disposed a separation roller 3*e* fixedly fitted over a rotatable shaft 3*d*. The separation roller 3*e* is arranged such that it can be tightly contacted with or departed away from the supply/discharge belt 3*c*. Specifically, as shown in FIG. 4, the shaft 3*d* is mounted to be vertically movable in elongate holes 17*c* bored in the side wall chassis 17*a*, 17*b*. The shaft 3*d* is also biased toward the supply/discharge belt 3*c* by tension springs $3f_1$, $3f_2$ attached as pressing means to the opposite ends of the shaft 3*d*. The separation roller 3*e* is thereby brought into pressure contact with the supply/discharge belt 3*c*.

A mechanism for transmitting drive power to the separation roller comprises a rubber belt 3*h* entrained between a pulley $3g_1$ mounted on the shaft $3a_1$ for transmitting the drive power to the supply/discharge belt 3*c* and a pulley $3g_2$ mounted on the separation roller shaft 3*d*. Rotation of the shaft $3a_1$ is transmitted to the separation roller shaft 3*d* through the belt 3*h*, thereby rotating the separation roller 3*e* in a direction of arrow d in FIG. 4. A friction clutch (not shown) is provided between the shaft 3*d* and the pulley $3g_2$ mounted on the shaft 3*d* so that torque greater than a certain value will not be transmitted to the separation roller 3*e*.

Accordingly, when torque is transmitted to the shaft $3a_1$ when the separation roller 3*e* is moved upwardly and the recording sheets 1 are pressed against the supply/discharge belt 3*c*, the supply/discharge belt 3*c* is rotated in the direction of arrow c to feed the uppermost recording sheet 1. Simultaneously, the separation roller 3*e* is rotated in the direction of arrow d to separate those recording sheets lying under the uppermost one. The uppermost recording sheet 1 is then fed to the platen 4. Note that the sheet feeding force applied by the supply/discharge belt 3*c* is set larger than the torque transmitted to the separation roller 3*e* through the friction clutch. Therefore, while the separation roller 3*e* is rotated in the direction of arrow d when plural recording sheets are fed, the roller 3*e* is rotated following the feed of the recording sheet 1 by the supply/discharge belt 3*c*, after one recording sheet 1 has been separated.

Tensile forces of the tension springs $3f_1$, $3f_2$ are set such that the tensile force of the tension spring $3f_2$ attached on the same side as the rubber belt 3*h* is smaller than the tensile force of the tension spring $3f_1$ attached on the opposite end side. The reason is as follows. Since the rubber belt 3*h* is entrained under constant tension between the pulleys $3g_1$ and $3g_2$ for transmitting the drive power to the separation roller 3*e* as mentioned above, the end of the separation roller shaft 3*d* on the same side as the belt 3*h* is also biased with that tension toward the supply/discharge belt 3*c*. Taking into account such tnsile action of the belt 3*h*, therefore, the springs $3f_1$, $3f_2$ attached to the opposite ends of the shaft 3*d* are set in their tensile forces to satisfy the relationship of $F_2+F_3=F_1$ assuming that the tensile force of the tension spring $3f_2$ attached on the same side of the belt 3*h* is $F_2$, the tensile force of the tension spring $3f_1$ on the opposite side is $F_1$, and the tensile force of the rubber belt 3*h* is $F_3$. With that setting, the separation roller 3*e* comes into pressure contact with the supply/discharge belt 3*c* by a force uniform in the axial direction of the separation roller 3*e* so that the recording sheets 1 are surely separated one by one and fed to the the platen 4.

Next, a mechanism for departing the separation roller 3*e* away from the supply/discharge belt 3*c* will be described.

Figure 16:
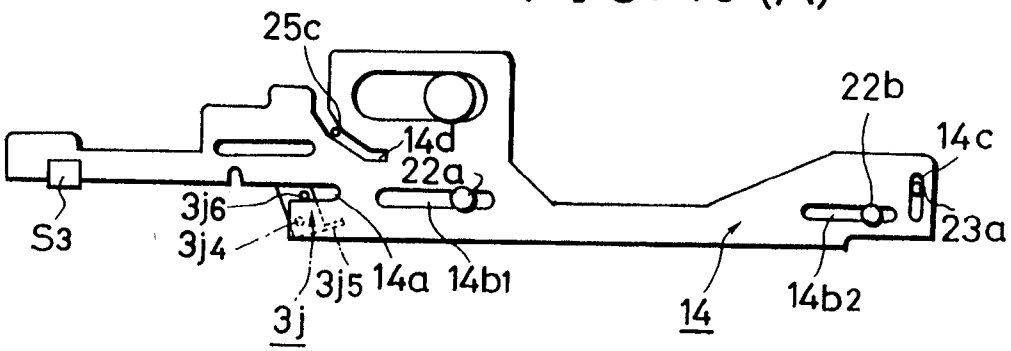
Figure 16:
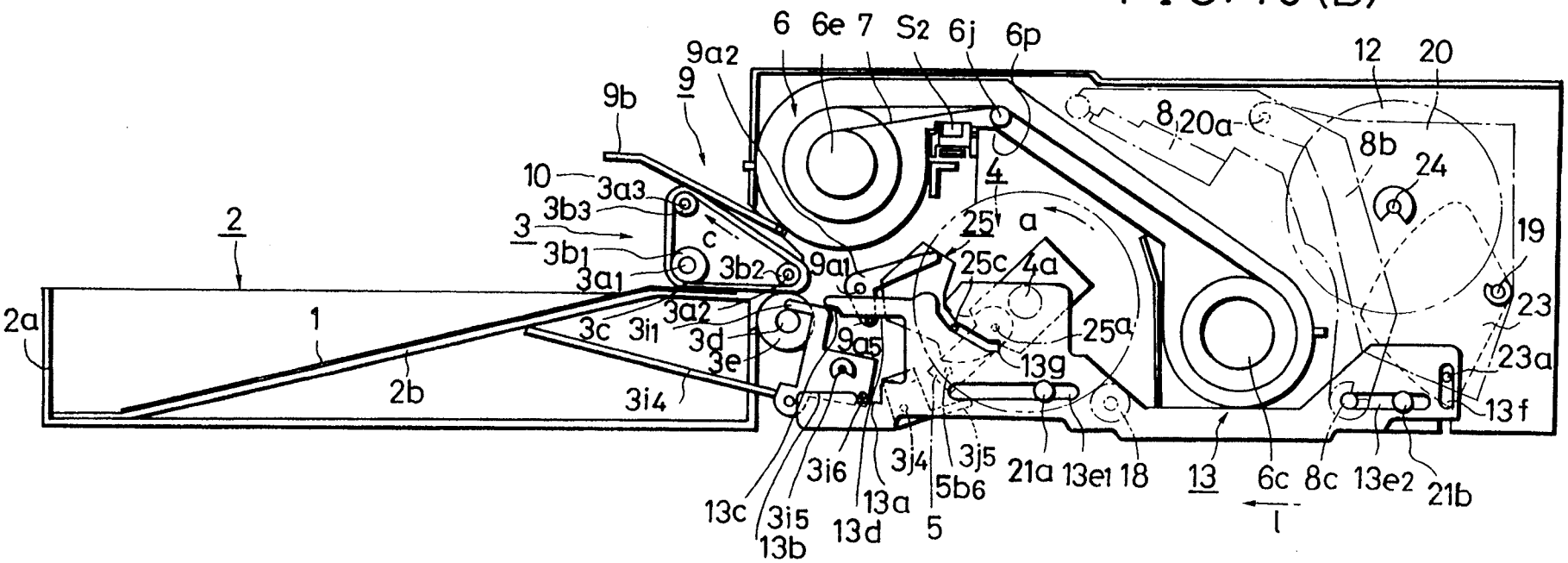

A feed plate 3*i* is disposed near the separation roller 3*e*, and the separation roller 3*e* is departed away from the supply/discharge belt 3*c* upon rotation of the feed plate 3*i*. More specifically, as shown in FIGS. 2(A), 2(B) and 3, a pair of crank-like latch members $3i_1$, $3i_2$ for latching the separation roller shaft 3*d* are fixed to the opposite ends of a connecting member $3i_3$, and a sheet push-up member $3i_4$ is attached to the nearly central portion of the connecting member $3i_3$ through a spring (not shown). The latch members $3i_1$, $3i_2$ are rotatably supported by respective shafts $3i_5$ to the side wall chassis 17*a*, 17*b*. One latch member $3i_1$ is provided with a cam projection $3i_6$ on the outer surface. As shown in FIGS. 16(A) and 16(B), therefore, when the cam projection $3i_6$ is positioned in a first engagement portion 13*a* formed as a recess of a first translation cam 13 (described later), the latch members $3i_1$, $3i_2$ latching the separation roller shaft 3*e* are rotated clockwise about the respective shafts $3i_5$ by the tensile forces of the tension springs $3f_1$, $3f_2$ shown in FIG. 4, whereby the separation roller 3e is brought into pressure contact with the supply/discharge belt 3c (state shown in FIG. 16(B)). When the translation cams 13, 14 are further slid to the positions shown in FIGS. 17(A), 17(B), the cam projection $3i_6$ is pushed by a rising edge 13h of the first translation cam 13 to further rotate the feed plate 3i clockwise, so that the sheet push-up member $3i_4$ is also rotated clockwise to push up the sheet bearing member 2b in the cassette 2. Therefore, the uppermost one of the recording sheets 1 resting on the sheet bearing member 2b is brought into pressure contact with the supply/discharge belt 3c for feeding upon rotation of the belt 3c. Incidentally, a level shift of the sheet push-up member $3i_4$ displaced due to increase or decrease in the number of the recording sheets 1 is absorbed by a spring (not shown).

Meanwhile, when the cam projection $3i_6$ is positioned on a second engagement portion 13b of the first translation cam 13, the feed plate 3i is rotated counterclockwise about the shafts $3i_5$ to push the separation roller shaft 3d downwardly. Accordingly, the separation roller 3e is departed away from the supply/discharge belt 3c, and the sheet bearing member 2b is lowered to depart the recording sheets 1 away from the supply/discharge belt 3c (state shown in FIG. 2(B)). In this state, even when the supply/discharge belt 3c is rotated, the recording sheet 1 will not be fed from the cassette 2 into the apparatus.

The recording sheet 1 fed by the supply/discharge belt 3c one by one is detected by a sheet end sensor S1 and then strikes its distal end against a register member 3j to be properly positioned after further feeding of a predetermined distance. The register member 3j will now be described.

As shown in FIGS. 2(A), 2(B) and 3, the register member 3j comprises a rotatable plate $3j_1$ which is bent at the opposite ends to form side plate portions $3j_2$, $3j_3$. The side plate portions $3j_2$, $3j_3$ are rotatably mounted to the side wall chassis 17a, 17b via respective shafts $3j_4$. A press member $3j_5$ having a shape of substantially channel section and made of a leaf spring (e.g., phosphor bronze plate) is attached to the rotatable plate $3j_1$ near its center. As the rotatable plate $3j_1$ rotates, the distal end of the press member $3j_5$ is tightly contacted with or departed away from the surface of the platen 4.

The rotatable plate $3j_1$ is rotated with movement of the second translation cam 14. More specifically, as shown in FIGS. 16(A) and 16(B), a cam projection $3j_6$ is provided on the side plate portion $3j_3$ formed at one side of the rotatable plate $3j_1$. When the cam projection $3j_6$ is riding over an engagement portion 14a of the second translation cam 14, the rotatable plate $3j_1$ is rotated counterclockwise about the shafts $3j_4$, causing the distal end of the press member $3j_5$ to be brought into pressure contact with the platen 4. When the cam projection $3j_6$ is disengaged from the engagement portion 14a, the rotatable plate $3j_1$ is rotated clockwise about the shafts $3j_4$ by its dead load or gravity, causing the press member $3j_5$ to be departed away from the platen 4, as shown in FIG. 2.

Figure 5:
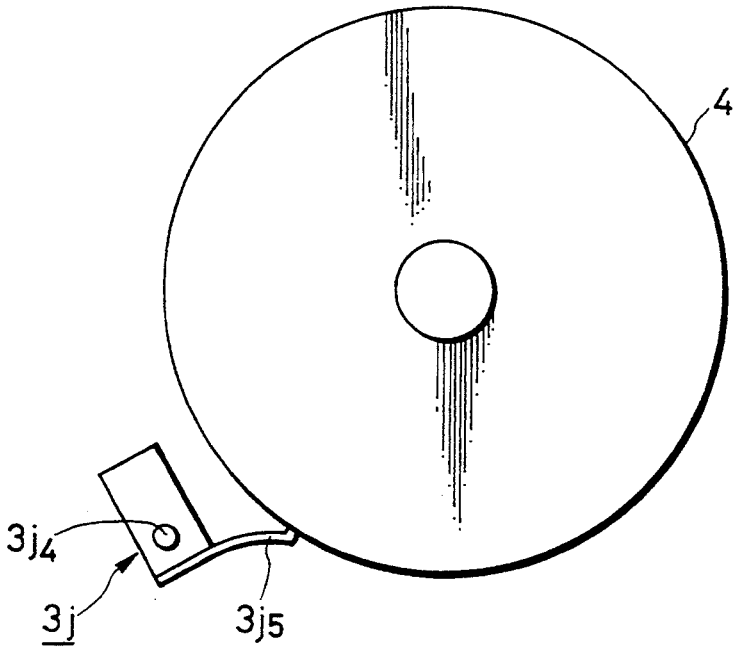
FIG. 5 is an explanatory view showing a state where a register member is in pressure contact with a platen.

The press member $3j_5$ is formed of a leaf spring as mentioned above. Therefore, the press member $3j_5$ is bent as shown in FIG. 5 when pressed against the surface of the platen 4, so that the distal end of the press member $3j_5$ is surely brought into pressure contact with the platen 4 by the resulting elastic force. The leading end of the recording sheet 1 fed by the supply/discharge belt 3c is thus positioned by being abutted against the press member $3j_5$. Also, the press member $3j_5$ is bifurcated into a shape of substantially channel section, and hence comes into pressure contact with the platen 4 at two points spaced parallel to the axial direction thereof. Accordingly, even if the recording sheet 1 is fed in a skewed condition, the sheet end is made parallel to the axial direction of the platen 4 at the time when the sheet end abuts against the distal end of the press member at both the two points. As a result, the recording sheet is positioned such that the above skewed feed has been corrected.

The recording sheet 1 which has been thus fed to a predetermined position on the platen 4 and positioned at its leading end by the supply means 3, is gripped and fed by the gripper 5 over the surface of the platen 4.

Next, construction of the feed means including the platen 4 and the gripper 5 will be described.

The platen 4 comprises a cylindrical member having a rubber sheet circumscribed over the outer periphery thereof, and a rotary shaft 4a projecting out from the opposite side ends of the cylindrical member and rotatably supported to the side wall chassis 17a, 17b. A gear mounted to one end of the shaft 4a of the platen 4 is meshed with a platen gear 16c of clutch means 16 (described later), and torque is transmitted to the platen 4 through the clutch means 16. The platen 4 is thereby rotated in the direction of arrow a in FIG. 2(B).

Figure 6:
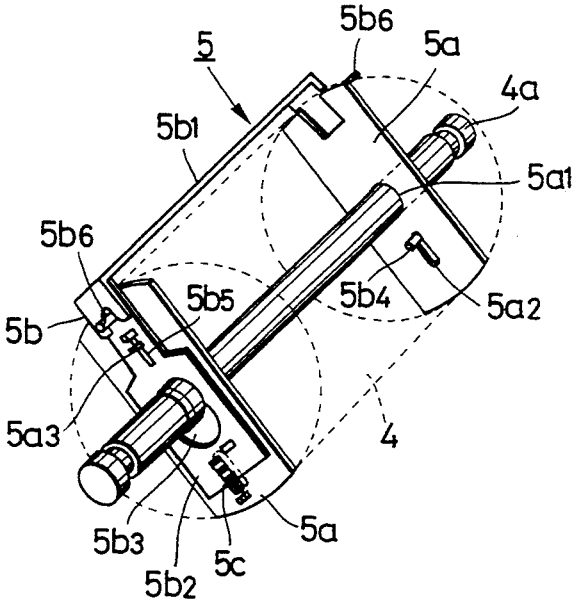
FIG. 6 is an explanatory view showing the construction of a gripper.
Figure 7:
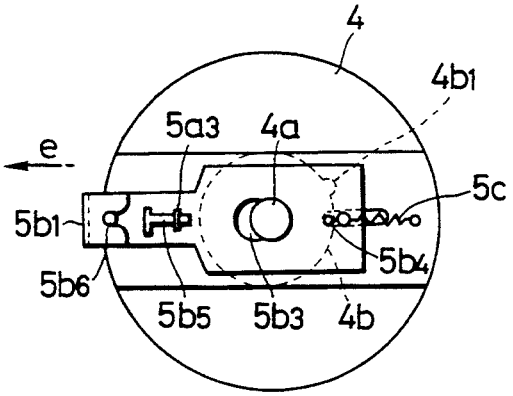

The gripper 5 is integrally attached to the platen 4. As shown in FIG. 6, the gripper 5 comprises a pair of base plates 5a attached to the opposite side faces of the platen 4, respectively, and a grip plate 5b having a substantially channel-like shape and capable of being tightly contacted with or departed away from the peripheral surface of the platen 4.

The base plates 5a are each formed nearly at its center with a circular hole $5a_1$ through which the platen shaft 4a is inserted. On each of the opposite sides of the circular hole $5a_1$, there is bored a guide hole $5a_2$ in the form of an elongate hole and there is provided a slide projection $5a_3$, respectively.

On the other hand, the grip plate 5b comprises a grip portion $5b_1$ and opposite side portions $5b_2$. The side portions $5b_2$ are each formed nearly at their center with an elongate hole $5b_3$ through which the platen shaft 4a is inserted. On each of the opposite sides of the elongate guide hole $5a_3$, there is provided a lock projection $5b_4$ projecting into the side face of the platen 4 while passing through the guide hole $5a_2$ of the base plate 5a, and there is bored a slide hole $5b_5$ in the form of an elongate hole engaged with the slide projection $5a_3$ of the base plate 5a, respectively. At a predetermined position of each side portion $5b_2$, there is provided a cam projection $5b_6$ engaged with a gripper cam (described later) for departing the grip portion $5b_1$ away from the peripheral surface of the platen.

Now, in order to mount the gripper 5 onto the platen 4, the slide projections $5a_3$ of the base plates 5a are fitted into the slide holes $5b_5$ of the grip plates 5b and the lock projections $5b_4$ of the grip plates 5b are fitted into the guide holes $5a_2$ of the base plates 5a, respectively, thereby constituting the gripper 5. The platen shaft 4a is fitted into the circular holes $5a_1$ of the base plates 5a and the elongate holes $5b_3$ of the grip plates 5b to mount the gripper 5 onto the platen 4.

Thus, the base plates 5a and the grip plate 5b become rotatable together with respect to the platen shaft 4a, and the grip plate 5b becomes slidable in the radial direction of the platen 4.

Further, tension springs 5c are attached between the respective base plates 5a and the grip plate 5b so that the grip plate 5b is normally biased toward the platen shaft 4a. The grip portion $5b_1$ is thereby held in pressure contact with the peripheral surface of the platen.

Figure 7:
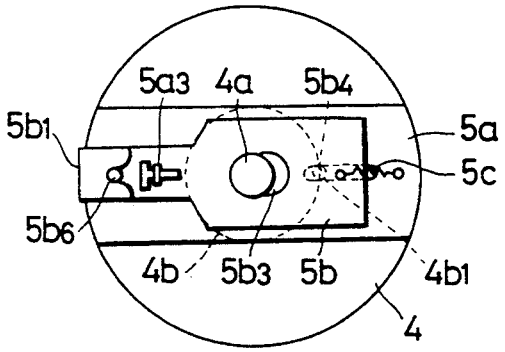
FIGS. 7(A) and 7(B) are explanatory views showing the different relationships between the gripper and the platen.

In the opposite side faces of the platen 4, as shown in FIGS. 7(A) and 7(B), there are formed circular grooves 4b and lock grooves $4b_1$ which are partially projected from the circular grooves 4b and engaged with the lock projections $5b_4$ of the grip plate 5b. Accordingly, when the lock projections $5b_4$ are engaged in the lock grooves $4b_1$, the grip portion $5b_1$ is held in pressure contact with the peripheral surface of the platen 4 and the gripper 5 is hence rotated together with rotation of the platen 4.

Meanwhile, as shown in FIG. 7(B), when the grip plate 5b is caused to slide in a direction of arrow e against tensile forces of the tension springs 5c, the lock projections $5b_4$ are disengaged from the lock grooves $4b_1$. By rotating the platen 4 under this condition, the lock projections $5b_4$ are now brought into engagement with the circular grooves 4b. In this state, therefore, the grip portion $5b_1$ is departed away from the peripheral surface of the platen 4 so that only the platen 4 is rotated until the lock projections $5b_4$ are engaged in the lock grooves $4b_1$ again upon the platen 4 making a revolution.

In other words, there are two modes in one of which the platen 4 and the gripper 5 are rotated together, and in the other of which only the platen 4 is rotated with respect to the gripper 5. While providing the two modes, the platen 4 and the gripper 5 are constituted as a one-piece unit. This facilitates assembly and improves positioning accuracy of the platen 4 with respect to the gripper 5.

Then, by gripping the leading end of the recording sheet 1 by the gripper 5 and rotating the platen 4 under that condition, the recording sheet 1 is fed along the peripheral surface of the platen 4.

As shown In FIG. 2(B), a pinch roller 18 as a push member is tightly contacted with the peripheral surface of the platen 4. Even when the recording sheet 1 is not gripped by the gripper 5 during a sheet discharging step (described later), for example, the pinch roller 18 ensures feeding of the recording sheet upon rotation of the gripper 5.

Mounting construction of the pinch roller 18 will now be described. As shown in FIGS. 3, 8(A), 8(B) and 8(C), the pinch roller 18 is fitted over a roller shaft 18a, as a pair at locations spaced from each other. The opposite ends of the roller shaft 18a are rotatably engaged in elongate grooves 17d formed in the side wall chassis 17a, 17b, while being biased by tension springs 18b toward the platen 4.

Accordingly, the roller shaft 18a is slidable along the elongate grooves 17d, whereby the pinch roller 18 can be tightly contacted with or departed away from the peripheral surface of the platen 4.

Figure 8:
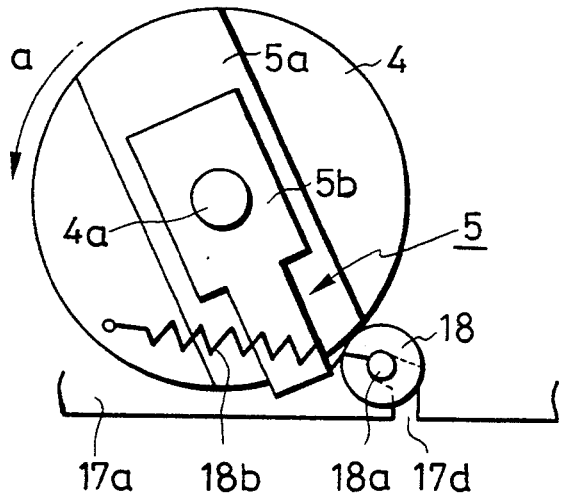
FIGS. 8(A)–8(C) are explanatory views showing different states of a pinch roller dependent on rotation of the gripper.
Figure 8:
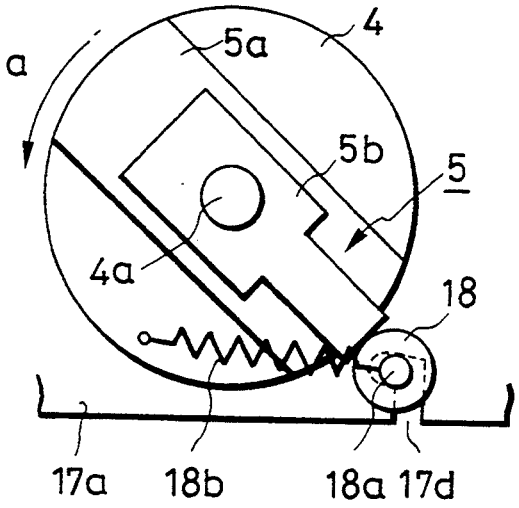
Figure 8:
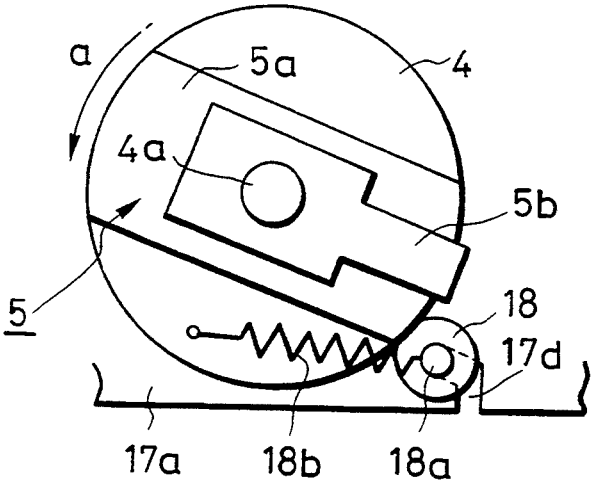

When the platen 4 is rotated with the recording sheet 1 gripped by the gripper 5, the pinch roller 18 operates as follows since it is attached as mentioned above. Specifically, as shown in FIGS. 8(A)–8(C), when the gripper 5 passes the pressure contact position between the platen 4 and the pinch roller 18, the pinch roller 18 rides over the gripper 5. After the gripper 5 has passed, the pinch roller 18 is brought into pressure contact with the platen 4 again by tensile forces of the springs 18b.

By this arrangement, the pinch roller 18 is prevented from interfering with rotation of the gripper 5 together with the platen 4, without need of providing special means adapted to retreat the pinch roller 18 from the platen 4 as the gripper 5 is rotated.

The recording sheet 1 thus fed by the platen 4 is tightly contacted with the ink sheet 7 by the recording head 8 to record predetermined information.

Next, construction of the recording head 8 will be described.

Figure 9:
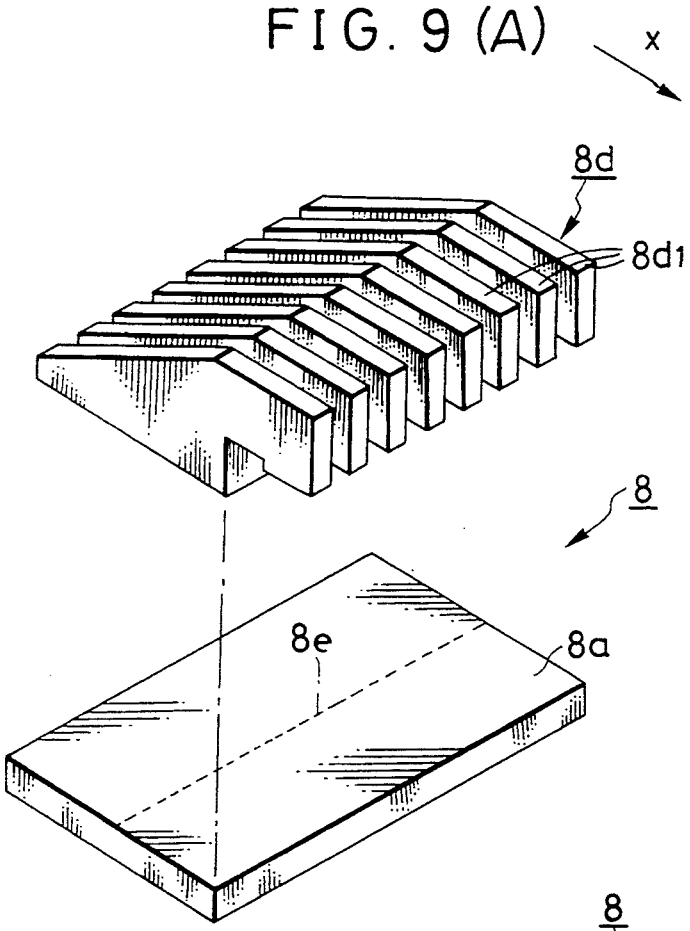
FIGS. 9(A) and 9(B) are explanatory views showing construction of a recording head and a heat sink member.
Figure 9:
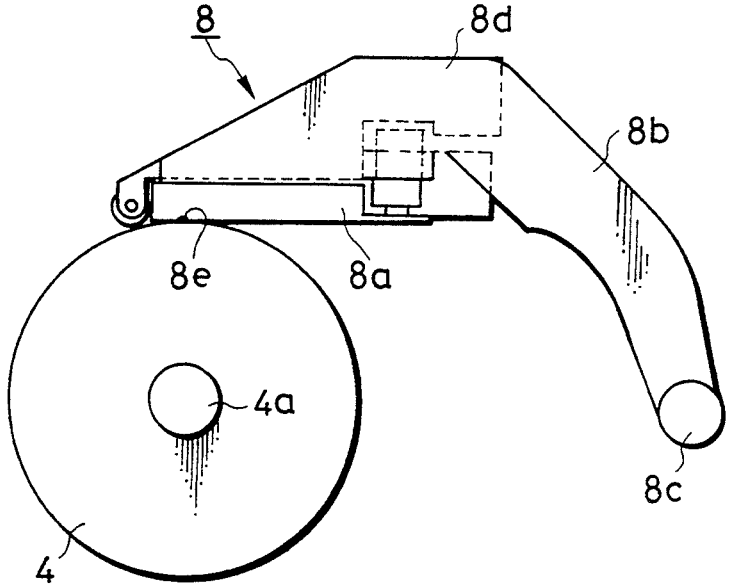

The recording head 8 is a thermal head of the line type in which, as shown in FIGS. 9(A) and 9(B), a substrate 8a has on its surface a linear array of multiple heating elements 8e heated upon energization in accordance with an image signal. The recording head 8b is, as shown in FIG. 3, supported at its opposite ends by head arms 8b which are rotatably mounted to the side wall chassis 17a, 17b via respective arm shafts 8c. It is to be noted that although the thermal head is used as one example of the recording head 8 in this embodiment, the recording head is not limited to the thermal transfer type, but may be of an ink jet head in which an ink liquid is ejected from discharge ports, a wired head, or a daisy wheel, for example.

Further, as shown in FIGS. 2(A) and 2(B), the head arms 8b are coupled by shafts 20a to head moving plates 20 which in turn are rotatably mounted to the side wall chassis 17a, 17b via rotatable shafts 19. Accordingly, as the head moving plates 20 rotate, the head arms 8b are turned allowing the recording head 8 to be tightly contacted with or departed away from the peripheral surface of the platen 4. The head moving plates 20 are rotated upon rotation of the rotating cams 12 as described later.

A heat sink member 8d is attached to the recording head 8 for preventing a build-up of heat in the substrate 8a.

As shown in FIGS. 9(A) and 9(B), the heat sink member 8d is attached to the rear surface of the head substrate 8a, made of a material with good heat radiating characteristics such as aluminum, and has a multiplicity of fins $8d_1$ for providing a wide heat radiating area. Also, the heat sink member 8d is formed to be longer than the head substrate 8a in a direction of arrow x in FIG. 9(A) (i.e., the direction perpendicular to the direction of the linear array of the heating elements 8e), such that when the heat sink member 8d is attached to the rear surface of the head substrate 8a, parts of the fins $8d_1$ project beyond the substrate 8a in the direction of arrow x.

With the heat sink member 8d formed wider than the substrate 8a in this embodiment, the heat radiating area is increased to improve the heat radiating effect, making it possible to record clearer and sharper images in the imaging process.

Next, the ink sheet cassette 6 to which one embodiment of the present invention is applied will be described below. Specifically, the ink sheet 7 heated by selective heating of the recording head 8 and the ink sheet cassette 6 for accommodating the ink sheet 7 will be described.

Figure 10:
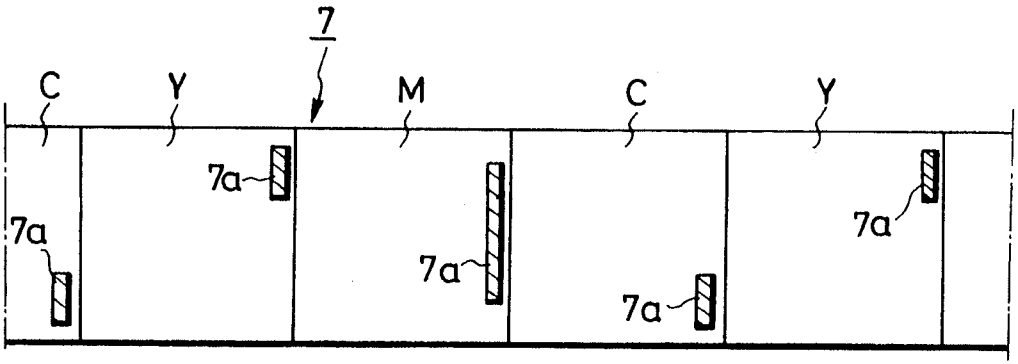
FIG. 10 is an explanatory view of an ink sheet.

First, the ink sheet 7 is formed of a base film having the same width as the length of the recording head 8 in the direction of the linear array thereof, the base film having an ink layer surface 7b on which transferable (heat-fusible or thermally sublimitated) ink is coated. Note that, as shown in FIG. 10, the ink sheet 7 of this embodiment is coated with three colors of ink, yellow Y, magenta M and cyan C, over respective predetermined regions in turn, with marks 7a formed at the boundary between every two color ink regions for discriminating the coated colors.

Figure 11:
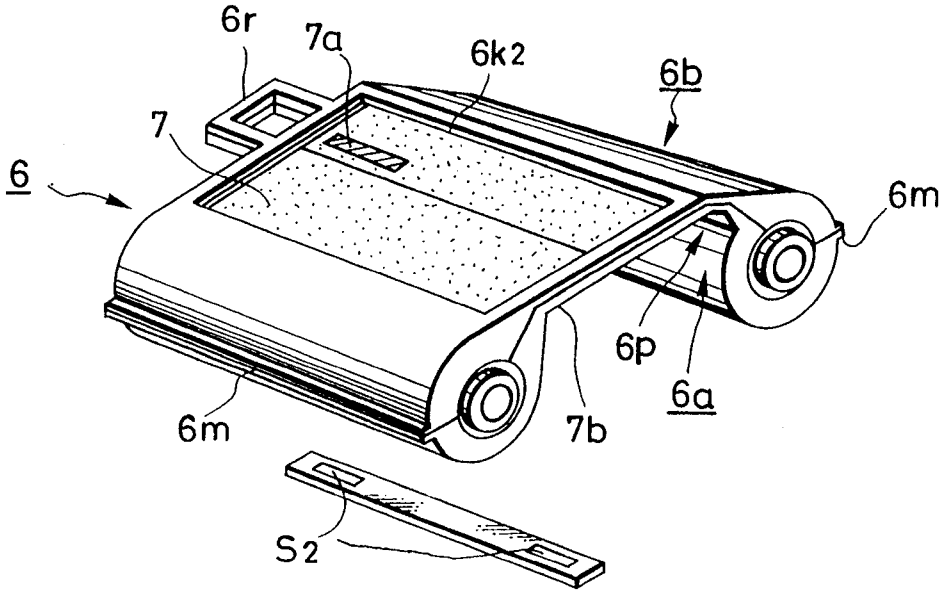
FIGS. 11(A) and 11(B) are explanatory views of an ink sheet cassette.
Figure 11:
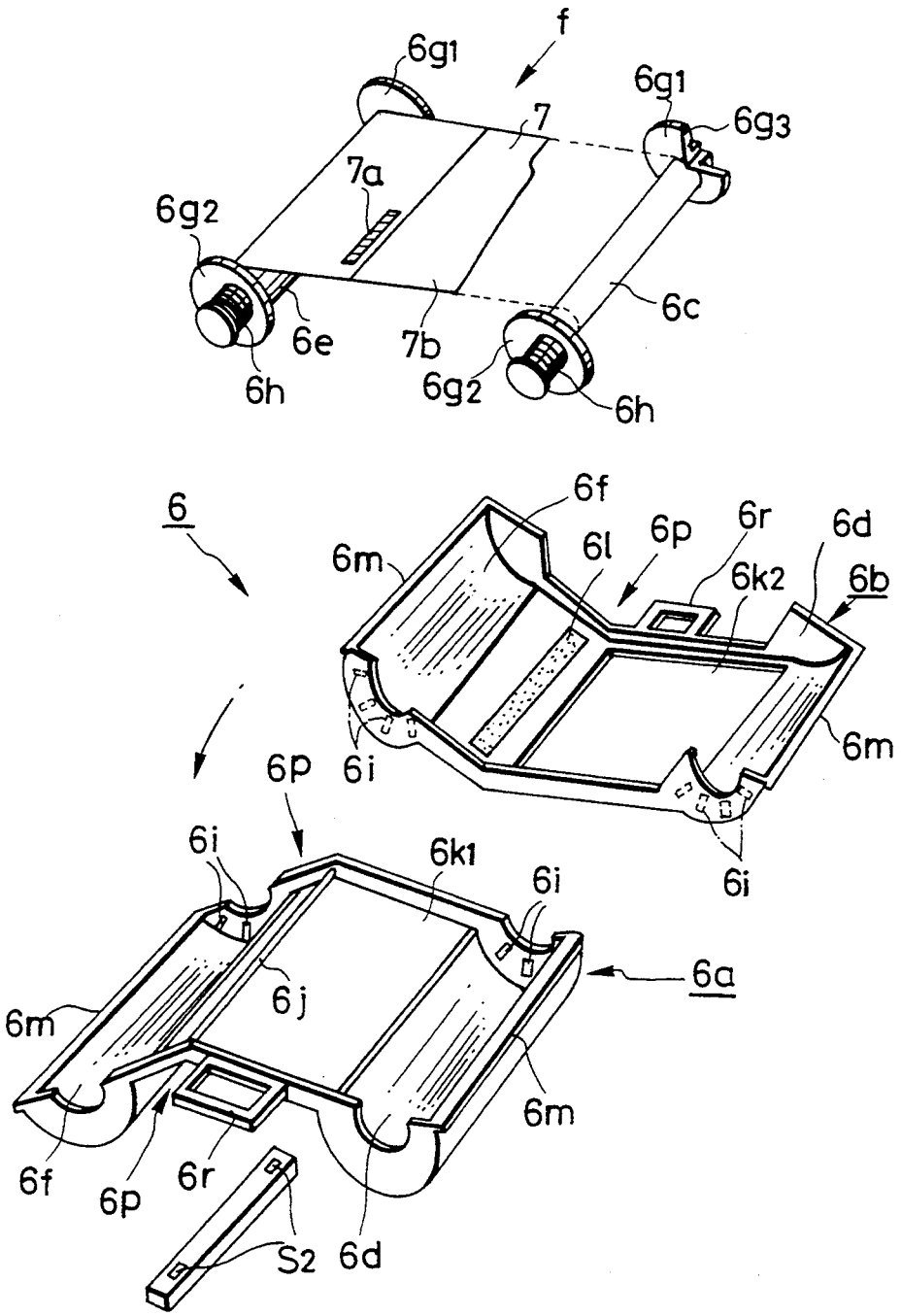

As shown in FIGS. 11(A) and 11(B), the ink sheet cassette 6 for accommodating the ink sheet 7 comprises a container body 6a and a cover member 6b which are fitted to each other to thereby constitute a container. A reel receiving portion 6d for receiving therein a feed reel 6c is formed at one end side of the container, while a reel receiving portion 6f for receiving therein a take-up reel 6e is formed at the other end side of the container. Thus, the ink sheet cassette is constituted by winding the ink sheet 7 at its opposite ends around the feed reel 6c and the take-up reel 6e and then putting both the reels 6c, 6e in the respective reel receiving portions 6d, 6f.

The ink sheet cassette 6 is provided with engagement ridges 6m at predetermined positions on the outer surface of the container, the ridges 6m capable of being fitted in engagement recesses 27 which are formed as ink sheet loading portions in the apparatus body. Accordingly, by fitting or withdrawing the engagement ridges 6 into or from the engagement recesses 27, the ink sheet cassette 6 can be attached to or detached from the body of the recording apparatus. Incidentally, denoted by 6r is a grip with which an operator can load or unload the ink sheet cassette 6 into or from the apparatus body by his or her hand.

The feed reel 6c and the take-up reel 6e are formed at their opposite ends with flanges $6g_1$, $6g_2$ as a pair for each reel. Lock projections $6g_3$ are provided on the outer surfaces of the flanges $6g_1$ on one side, and press springs 6h are set to be held against the outer surface of the flanges $6g_2$ on the other side. On the inner surfaces of the reel receiving portions 6d, 6f at the side where flanges $6g_1$ are to be fitted, there are radially formed lock grooves 6i in which the aforesaid lock projections $6g_3$ can be engaged.

Thus, the reels 6c, 6e placed in the container are both biased by the press springs 6h in one direction, while the lock projections $6g_3$ are held engaged with the lock grooves 6i. As a result, the reels 6c, 6e will not be rotated and the ink sheet 7 is hence prevented from from slacking during transportation of the ink sheet cassette 6, for example.

When the ink sheet cassette 6 is loaded in the body of the recording apparatus, the flanges $6g_1$ are pushed in a direction of arrow f in FIG. 11(A) by projections provided within the apparatus and having frictions (not shown) and a take-up gear 16i having frictions (not shown). This releases the lock projections $6g_3$ and the lock grooves 6i from their engaged state, allowing the reels 6c, 6e to rotate. Also, under the loaded condition of the ink sheet cassette 6, the take-up reel 6e is coupled to a take-up gear 16e of the clutch means 16 (described later). When torque is transmitted to the take-up reel 6e, the take-up reel 6e is rotated in a direction of arrow g in FIG. 2(B) so that the ink sheet 7 is successively led out of the feed reel 6c and taken up by the take-up reel 6e.

The ink sheet container of this embodiment is bent into a substantially triangular roof shape, projecting perpendicularly with respect to the ink layer surface 7a of the ink sheet 7, so that the feed path of the ink sheet 7 fed from the feed reel 6c to the take-up reel 6e is also bent correspondingly. While the container is bent at an angle of about 35° in this embodiment, the bend angle is not limited to this value, but may be set to any other desired values appropriately. A roller 6j as a guide member for guiding the bent feed of the ink sheet 7 is attached to a bent portion 6p of the container body 6a. In addition, on the lower surface of the reel receiving portion 6f for the take-up reel 6e of the container body 6a, there is formed a guide portion 6n for guiding the recording sheet 1 being fed along it.

The container body 6a and the cover member 6b are formed with windows $6k_1$, $6k_2$ for exposing the ink sheet 7 to the outside. The part of the ink sheet 7 exposed through the windows $6k_1$, $6k_2$ is pressed by the recording head 8 to be brought into pressure contact with the recording sheet 1. Specifically, the recording head 8 enters the ink sheet cassette 6 through the window $6k_2$ formed in the cover member 6b, while the ink layer surface 7b of the ink sheet 7 is brought to contact with the recording sheet 1 through the window $6k_1$.

Further, a reflecting plate 6l is attached to the inner surface of the cover member 6b at a predetermined position. The reflecting plate 6l serves to reflect a light beam from an ink sensor $S_2$ mounted to the side wall chassis 17a, 17b and comprises an optical sensor positioned below the container body 6a, as shown in FIG. 3 and 11(A), when the ink cassette 6 is loaded in the body of the recording apparatus. Thus, the light beam from the ink sensor $S_2$ reaches the reflecting plate 6l after passing through the window $6k_1$ of the container body 6a and the ink sheet 7. The reflected light from the reflecting plate is used to detect the presence or absence of the end marks 7a put on the ink sheet 7, whereby the end regions of the ink sheet 7 for respective colors are detected.

Since ink sheet cassette 6 according to this embodiment is formed into a bent shape as mentioned above, it becomes possible to reduce the height of the apparatus body when the ink sheet cassette 6 is loaded in the body of the recording apparatus as shown in FIGS. 1 and 2(B), thereby achieving a reduction in size of the apparatus. Besides, as described later, a part of the ink sheet cassette 6 also functions as a guide when the recording sheet 1 is discharged.

After ink on the ink sheet 7 has been transferred to the recording sheet 1 upon heating of the recording head 8 to complete recording, the recording sheet 1 is discharged by the discharge means 9. The discharge means 9 will now be described.

The discharge means 9 comprises a discharge lever 9a for leading the recording sheet 1 from the platen surface to the discharge port 10, and a guide member 9b cooperated with the aforesaid supply/discharge belt 3c for discharging the recording sheet 1.

As shown in FIG. 3, the discharge lever 9a is constituted by integrally attaching lever members $9a_2$, $9a_3$ to the opposite ends of a shaft $9a_1$ slightly longer than the peripheral surface of the platen 4 on which the rubber sheet is covered. The shaft $9a_1$ is rotatably mounted to the side wall chassis 17a, 17b. The lever member $9a_2$ on one side is bent into a hook-like or L shape and biased by a tension spring $9a_4$ counterclockwise as shown in FIGS. 2(B) and 3.

Further, the lever member $9a_2$ is provided with a cam projection $9a_5$. When the cam projection $9a_5$ is engaged with a third engagement portion 13c of the first translation cam 13 as shown in FIG. 2(B), the lever members $9a_2$, $9a_3$ are retreated away from the platen 4. On the other hand, when the cam projection $9a_5$ is engaged with a fourth engagement portion 13d as shown in FIG. 16(B), the discharge lever 9a is rotated clockwise so that the lever members $9a_2$, $9a_3$ are positioned near the opposite ends of the platen 4. Accordingly, when the recording sheet 1 continues to be fed with rotation of the platen 4 after it has been released from a gripped state by the gripper 5, the sheet end is led to the discharge port 10 while being guided at its opposite lateral edges by the lever members $9a_2$, $9a_3$.

Figure 12:
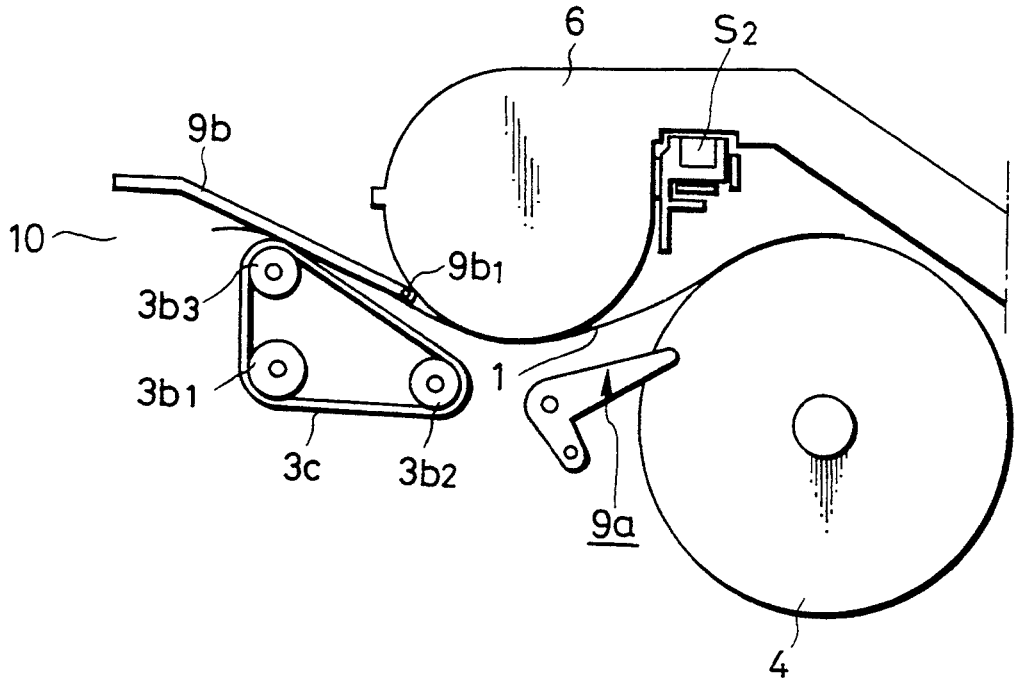
FIG. 12 is an explanatory view of a discharge guide.

Then, the guide member 9b is constituted by a member having a width larger than that of the recording sheet 1, and is disposed above the aforesaid supply/discharge belt 3c as shown in FIGS. 2(B) and 12. The guide member 9b is rotatably mounted to the side wall chassis 17a, 17b by the shafts $9b_1$ such that a part of the guide member 9b is brought into pressure contact with the supply/discharge belt 3c by its dead load or gravity under pressing force on the order of about 10–40 gf/cm$^2$.

Accordingly, the recording sheet 1 led by the discharge lever 9a onto the supply/discharge belt 3c is now fed between the supply/discharge belt 3c and the guide member 9b for discharge toward the discharge port 10 under cooperation thereof.

With this embodiment, since the guide member 9b is tightly contacted with the supply/discharge belt 3c with no need of means, such as a spring, to press the guide member 9b, it becomes possible to apply enough feed force to discharge the recording sheet 1 with simple structure and without increasing the number of parts.

Positioning control of the feed plate 3i, the register member 3j, the discharge lever 9a, the recording head 8 and the gripper 5 is performed by the cam members as positioning control members. The relationship between such respective components and the cam members will be described below.

The aforesaid first translation cam 13 is arranged at predetermined positions with horizontal elongate holes $13e_1$, $13e_2$, as shown in FIG. 2(B), in which are slidably fitted shafts 21a, 21b which project on the outer surface of one side wall chassis 17a. The first translation cam 13 is thus mounted to be movable within a range of the horizontal elongate holes $13e_1$, $13e_2$. Likewise, the second translation cam 14 is formed at predetermined positions with horizontal elongate holes $14b_1$, $14b_2$, as shown in FIG. 2(A), in which are slidably fitted shafts 22a, 22b which are projected on the outer surface of the other side wall chassis 17b. The second translation cam 14 is thus mounted to be movable within a range of the horizontal elongate holes $14b_1$, $14b_2$.

The first translation cam 13 and the second translation cam 14 are formed near their ends with vertical elongate holes 13f, 14c, respectively, in which the projections 23a of the cam moving plates 23 are engaged. The cam moving plates 23 are rotatably mounted to the side wall chassis 17a, 17b about the same shafts 19 as the aforesaid rotatable shafts of the head moving plates 20.

Figure 13:
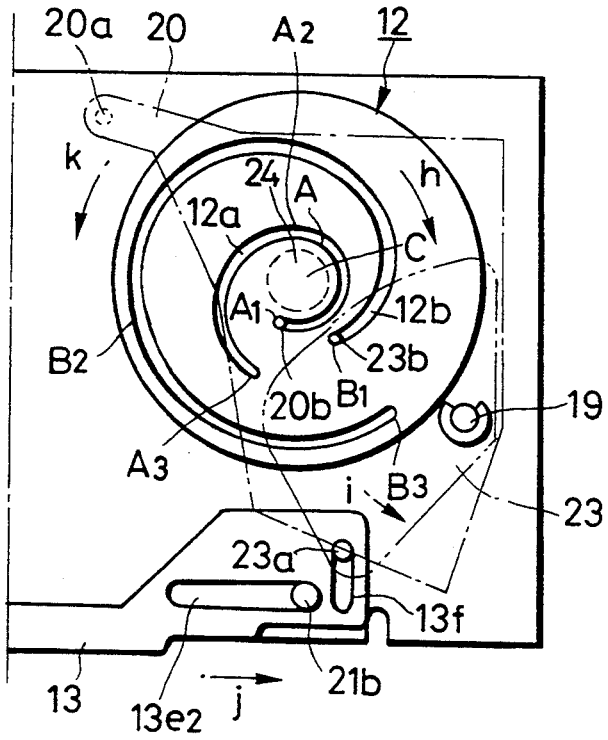
FIG. 13 is an explanatory view showing the relationship between a rotating cam and the recording head as well as a translation cam.

The cam moving plates 23 and the head moving plates 20 are turned by the rotating cams 12 rotatably mounted to the side wall chassis 17a, 17b about respective shafts 24. This cam mechanism will now be described in detail. First, the rotating cams 12 are each formed with two inner surface cam grooves 12a, 12b as shown in FIG. 13. A cam projection 20b provided at a predetermined position of the head moving plate 20 is fitted in one cam groove 12a, and a cam projection 23b provided at a predetermined position of the cam moving plate 23 is fitted in the other cam groove 12b. Therefore, as the cam 12 is rotated, the cam projections 20b, 23b are forced to slide along the cam grooves 12a, 12b, respectively.

As shown in FIG. 13, the cam groove 12a coupled with the head moving plate 20 is formed such that it has a circular shape equi-distantly spaced from the rotation center C of the rotating cam 12 in a range from point $A_1$ to point $A_2$, and then has the distance from the rotation center C gradually increased in a range from point $A_2$ to point $A_3$.

The cam groove 12b coupled with the cam moving plate 23 is formed such that it has the distance from the rotation center C gradually increased in a range from point $B_1$ to point $B_2$, and then has a circular shape equidistantly spaced from the rotation center C in a range from point $B_2$ to point $B_3$.

Accordingly, when the rotating cams 12 are rotated in a direction of arrow h in FIG. 13, the cam moving plates 23 are rotated in a direction of arrow i during a range until the cam projections 23b of the cam moving plates 23 move from point $B_1$ to point $B_2$, whereby the first and second translation cams 13, 14 are forced to slide in a direction of arrow j. During this time, since the cam projections 20b of the head moving plates 20 are in the range from point $A_1$ to $A_2$, the head moving plates 20 are not rotated, nor is the recording head 18 moved.

When the rotating cams 12 are further rotated from the above condition, the cam projections 23b of the cam moving plates 23 enter the region from point $B_2$ to point $B_3$, resulting in that the cam moving plates 23 are not rotated, nor are the translation cams 13, 14 slid. On the other hand, the cam projections 20b of the head moving plates 20 enter the region from $A_2$ to point $A_3$, whereby the head moving plates 20 are rotated in a direction of arrow k and the recording head 8 is moved downwardly.

When the rotating cams 12 are rotated in a direction opposite to the above, both the translation cams 13, 14 and the recording head 8 are operated in a reversed manner.

In this connection, at the time when the cam projections 20b of the head moving plates 20 reach the positions of point $A_2$ upon rotation of the rotating cam 12, the cam projections 23b of the cam moving plates 23 are positioned at point $B_2$. Stated otherwise, the cam grooves 12a, 12b are set such that both the translation cams 13, 14 are held at rest while the recording head 8 is moving, and the recording head 8 is held at rest while both the translation cams 13, 14 are moving.

Further, as shown in FIG. 1, a sensor contactor 26 is attached to the rotating cam 12 for corotation therewith. A rotation sensor $S_5$ comprising two touch sensors is attached to the side wall chassis 17a at a predetermined position around the sensor contactor 26. The sensor $S_5$ is arranged such that when the recording head 8 is brought into a head-up or head-down state upon rotation of the rotating cam 12, the contactor 26 contacts with the respective touch sensors, thereby detecting the up or down state of the recording head 8.

While both the translation cams 13, 14 are slid with the above arrangement, gripper cams 25 are turned upon such sliding of both the translation cams 13, 14 to perform positioning control of the gripper 5.

The gripper cams 25 are mounted to the side wall chassis 17a, 17b, respectively. As shown in FIG. 2(B), the gripper cams 25 are each rotatable about a shaft 25a, and formed with a first engagement portion $25b_1$ and a second engagement portion $25b_2$ for departing the grip portion $5b_1$ away from the peripheral surface of the platen 4. A cam projection 25c is provided at a predetermined position of each of the gripper cams 25.

The first translation cam 13 and the second translation cam 14 are formed at their predetermined positions with cam grooves 13g, 14d inclined downwardly, in which the cam projections 25c of the gripper cams 25 are engaged, respectively.

Figure 17A:
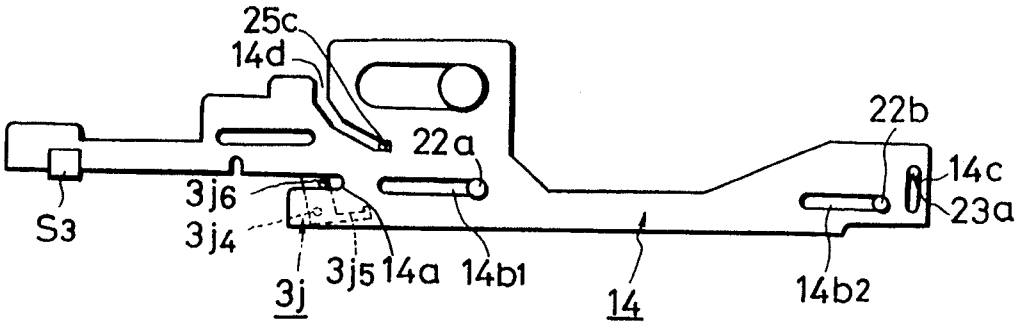
Figure 17B:
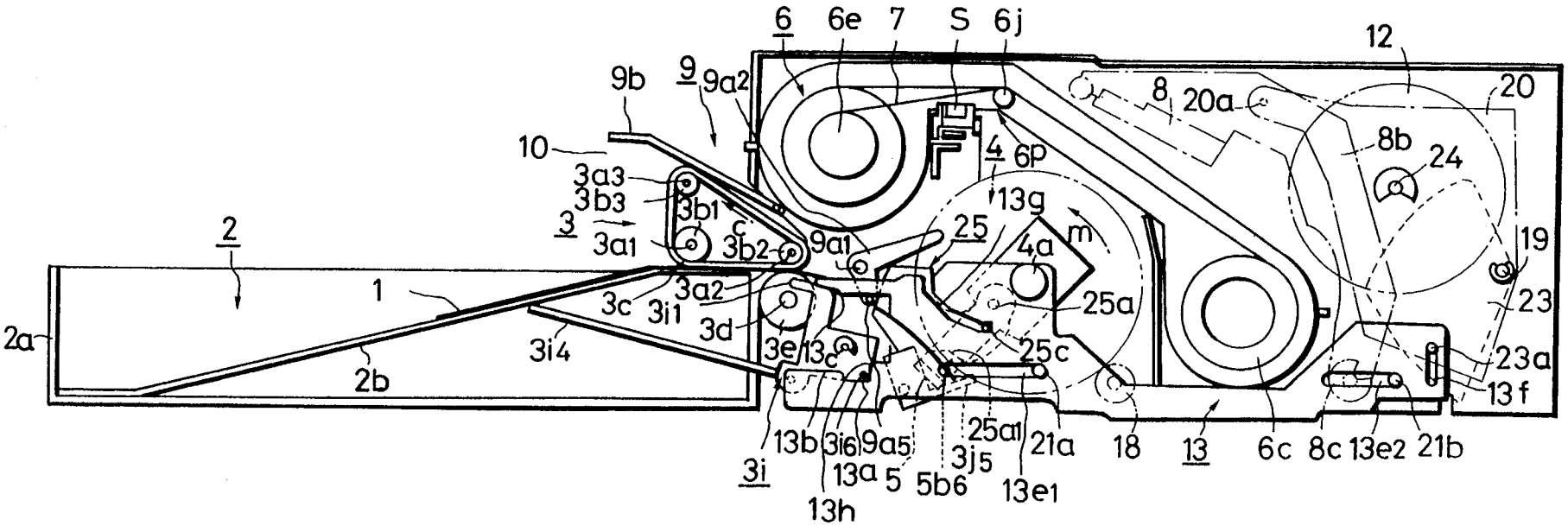

Therefore, when both the translation cams 13, 14 are slid in a direction of arrow l in FIGS. 16(B) and 17(B), the cam projections 25c are forced to slide along the cam grooves 13g, 14d so that the gripper cams 25 are rotated in a direction of arrow m. Such rotation of the gripper cams 25 pushes up the cam projections 5b6 of the gripper 5 which are in a ready state at predetermined positions, thereby releasing the gripper 5 from its state tightly contacted with the platen 4, as described later.

While both the translation cams 13, 14 are slid together by the rotating cams 12 as mentioned above, a translation cam sensor $S_3$ is disposed at the distal end portion of the second translation cam 14 for detecting a slide position of the second translation cam 14. When the second translation cam 14 is slid from the right to the left in FIG. 2(A), the cam sensor $S_3$ is turned on and off in five stages from switches I through V.

Detection of an up or down state of the recording head 8 by the rotation sensor $S_5$ and 5-stage detection of the translation cams by the cam sensor $S_3$ are combined to permit the switching sequence in six stages below. States of the feed plate 3i, the register member 3j, the discharge lever 9a and the gripper cams 25, as well as the relationship between the rotating cams 12 and the recording head 8, as established when the translation cams 13, 14 are slid to the respective switching positions, are as follows.

(1) In the case of switch −I (state of FIGS. 2(A) and 2(B))

① Feed plate 3i:

The cam projection $3i_6$ is engaged with the second engagement portion 13b of the first translation cam 13 (this state will be hereinafter referred to as a down state).

② Register member 3j:

The cam projection $3i_6$ is not engaged with the engagement portion 14a of the second translation cam 14 (this state will be hereinafter referred to as a down state).

③ Discharge lever 9a:

The cam projection $9i_5$ is engaged with the third engagement portion 13c of the first translation cam 13 (this state will hereinafter be referred to as an up state).

④ Recording head 8:

Held in a head-down state.

⑤ Gripper cams 25:

Held in a rest state.

Note that the switch −I is detected by the rotation sensor $S_5$.

(2) In the case of switch I:

Only the recording head 8 is brought into a head-up state upon rotation of the rotating cams 12. The other components remain in the same state as in the case of switch −I.

Figure 14:
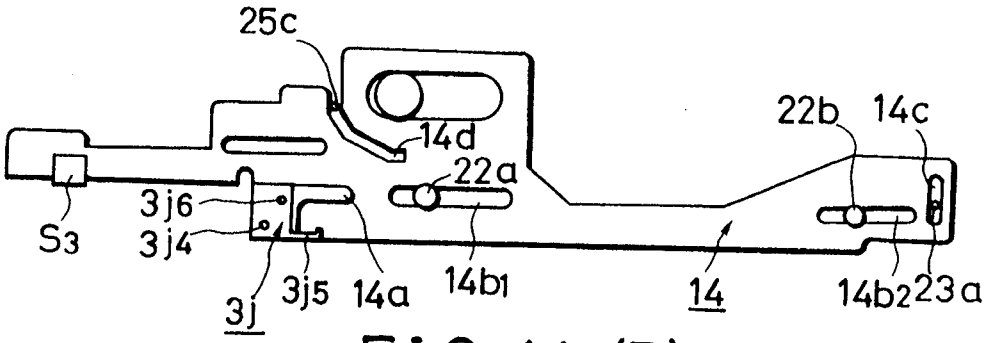
Figure 14:
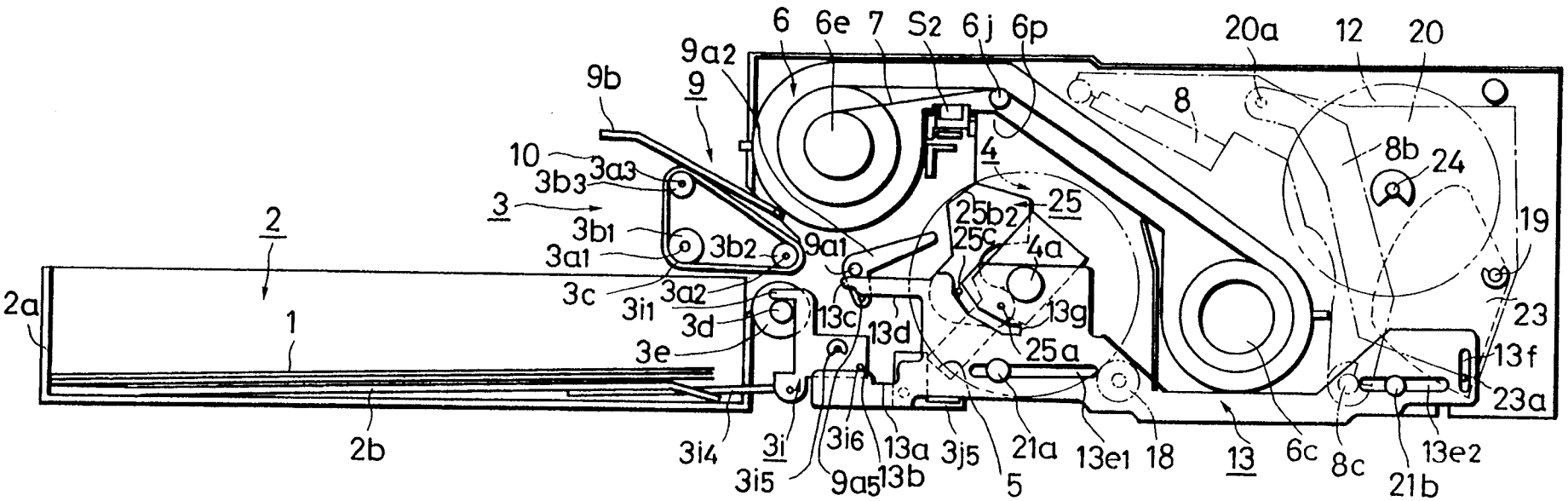

(3) In the case of switch II (state of FIGS. 14(A) and 14(B))

① Feed plate 3i:

Remains in a down state as with the case of switch −I.

② Regist member 3j:

Remains in a down state as with the case of switch −I.

③ Discharge lever 9a:

The cam projection $9i_5$ is engaged with the fourth engagement portion 13d of the first translation cam 13 (this state will be hereinafter referred to as a down state).

④ Recording head 8:

Held in a head-up state.

⑤ Gripper cams 25:

Rotated counterclockwise.

Figure 15:
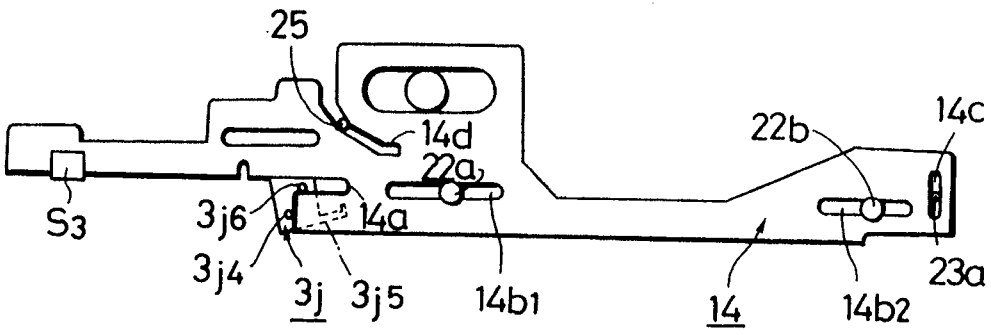
Figure 15:
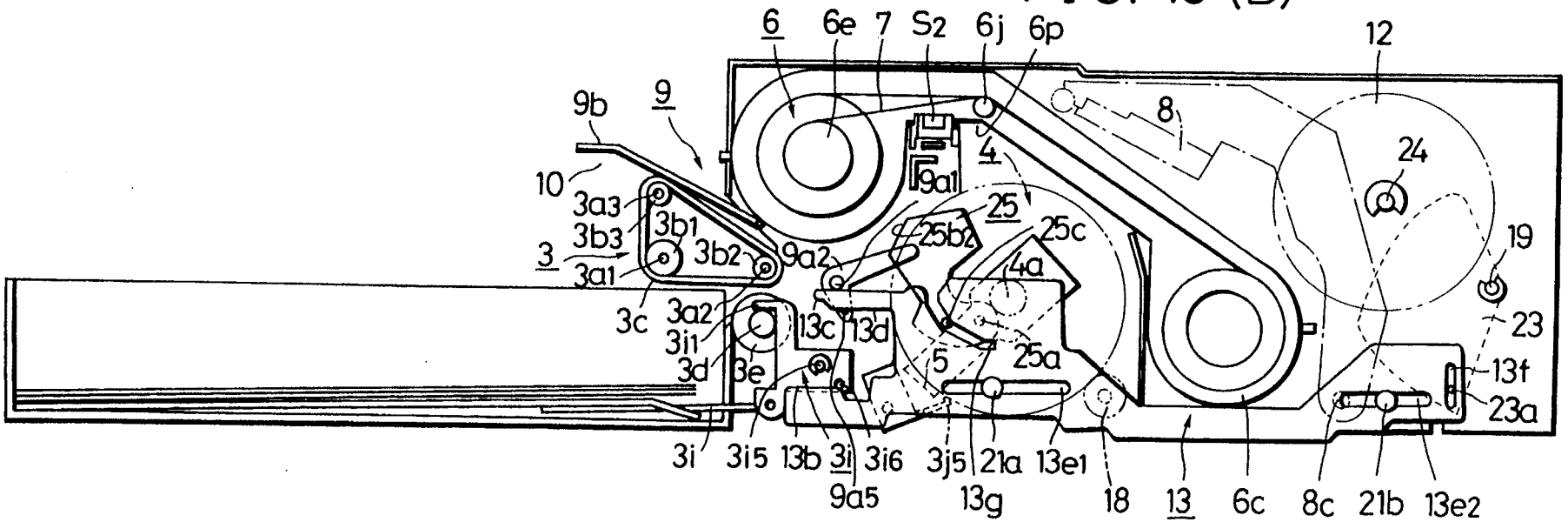

(4) In the case of switch III (state of FIGS. 15(A) and 15(B))

① Feed plate 3i:

Remains in a down state as with the case of switch −I.

② Register member 3j:

The cam projection $3i_6$ is engaged with the engagement portion 14a of the second translation cam 14 (this state will be hereinafter referred to as an up state).

③ Discharge lever 9a:

Remains in a down state as with the case of switch II.

④ Recording head 8:

Held in a head-up state.

⑤ Gripper cams 25:

Rotated counterclockwise.

(5) In case the of switch IV (state of FIGS. 16(A) and 16(B)):

① Feed plate 3i:

The cam projection $3i_6$ is engaged with the first engagement portion 13a of the first translation cam 13 (this state will be hereinafter referred to as an up state).

② Register member 3j:

Remains in an up state as with the case of switch III.

③ Discharge lever 9a:

Remains in a down state as with the case of switch II.

④ Recording head 8:

Held in a head-up state.

⑤ Gripper cams 25:

Rotated counterclockwise.

(6) In the case of switch V (state of FIGS. 17(A) and 17(B)):

① Feed plate 3i:

The cam projection $3i_6$ is pushed by the rising edge 13h of the first translation cam 13 so that the sheet push-up member $3i_4$ is rotated to press the recording sheet 1 against the supply/discharge belt 3c.

As to the other components, only the gripper cams 25 are rotated counterclockwise and the remaining components remain in the same state as that in the case of switch IV.

The above respective states are listed in Table 1 below.

TABLE 1

| Cam switch | −I | I | II | III | IV | V |
|---|---|---|---|---|---|---|
| Rotating cam | | | rotated | | | |
| Translation cam | rest | | | moved | | |
| Discharge lever | up | | | down | | |
| Register lever | down | | | | up | |
| Feed plate | | down | | | | up |
| Gripper cam | rest | | | rotated | | |
| Recording head | down | | | up | | |

As explained above, since positioning control of the respective components associated with the supply means 3, the recording head 8, the discharge means 9 and the gripper 5 is performed by a series of operations of the cam members in this embodiment, there is no need of individually providing separate mechanisms necessary for operating the respective components. As a result, the manufacture cost can be lowered by reducing the number of parts, while achieving efficient use of space.

Figure 20:
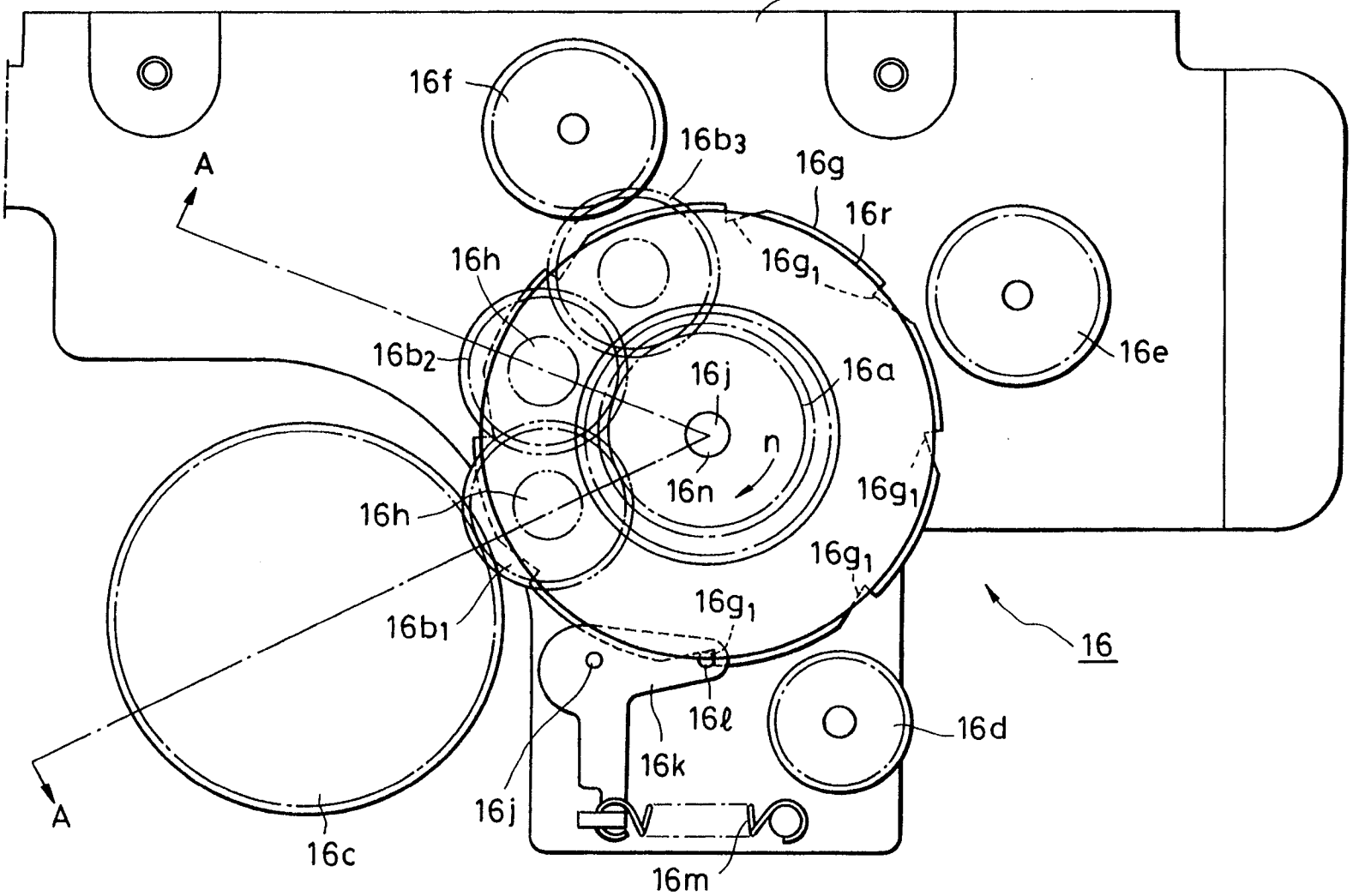
FIGS. 20 and 21 are explanatory views showing the construction of the clutch means.

Next, the clutch means 16 for selectively transmitting drive power to the supply/discharge belt 3c, the platen 4 or the take-up reel 6e of the ink sheet 7 will be described with reference to FIGS. 20 and 21. FIG. 20 is an explanatory plan view of the clutch means 16, and FIG. 21 is an explanatory sectional view taken along section line A—A in FIG. 20.

As shown in FIG. 20, the clutch means 16 is rotated forward in a direction of arrow n upon reversible rotation of the stepping motor 15, and has a sun gear 16a rotating backward and three planetary gears 16b$_1$, 16b$_2$, 16b$_3$ held in mesh with the sun gear 16a. The planetary gears 16b$_1$, 16b$_2$, 16b$_3$ are arranged so as to be meshed with a platen gear 16c for transmitting drive power to the platen 4, a supply/discharge gear 16d for transmitting drive power to the supply/discharge belt 3c, a platen lock gear 16e for locking rotation of the platen 4, and a take-up gear 16f for transmitting drive power to the take-up reel 6e of the ink sheet cassette 6 in sequence.

Figure 21:
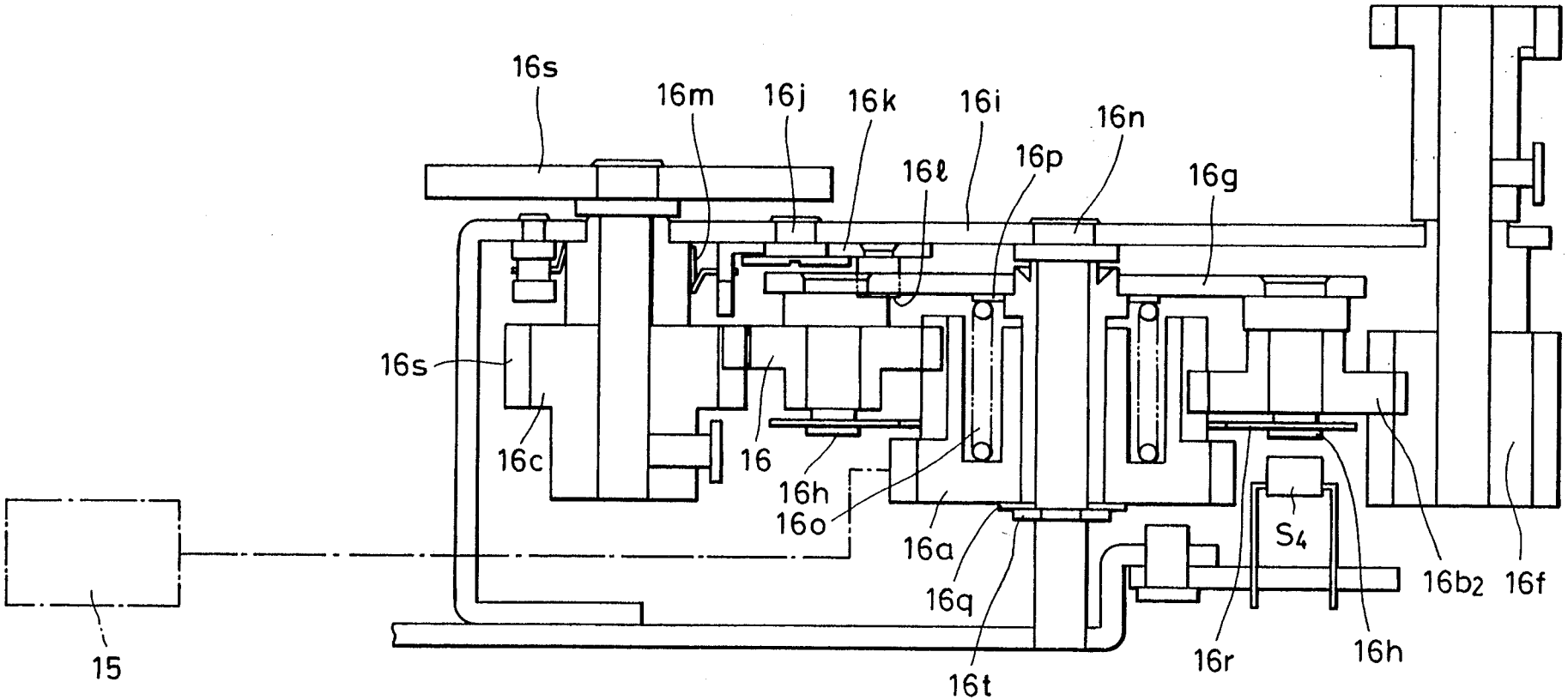

The positional relationship between the respective gears is set, as shown in FIGS. 20 and 21, such that the planetary gears 16b$_1$, 16b$_2$, 16b$_3$ are arranged around the sun gear 16a with a spacing of 45° therebetween, and are rotatably mounted on respective planetary shafts 16h attached to a rotation checking plate 16g. Further, the platen gear 16c, the supply/discharge gear 16d, the platen lock gear 16e and the take-up gear 16f are arranged around the rotation checking plate 16g with a spacing of 90° therebetween in this order.

As shown in FIG. 20, the rotation checking plate 16g has a plurality of latch slots 16g$_1$ cut out into a hook-like shape and formed around the outer peripheral surface thereof with equal intervals. The latch slots 16g$_1$ are arranged to be engageable with a latch projection 16 attached to one end of a hook-like plate 16k rotatable about a shaft 16j secured to a clutch chassis 16i. The other end of the hook-like plate 16k is pulled by a tension spring 16m so that the arch projection 16 is normally biased in a direction to be engaged with any of latch slots 16g$_1$.

The relationship between the sun gear 16a and the rotation checking plate 16g is as follows. Specifically, as shown in FIG. 21, a sun shaft 16n is attached to the clutch chassis 16i. The sun gear 16a and the rotation checking plate 16g are rotatably mounted on the shaft 16n with a compression spring 16o set therebetween through a friction washer 16p. A stop ring 16t and a washer 16q are also fitted to prevent the sun gear 16a from moving downwardly in FIG. 21, while the rotation checking plate 16g is mounted so as to be immobile in the axial direction. Accordingly, as the stepping motor 15 rotates, the sun gear 16a is rotated to transmit its torque to the rotation checking plate 16g by friction force produced through the friction washer 16p and the compression spring 16o held pressed against the friction washer 16b. This prevents torque greater than a certain value from being transmitted to the rotation checking plate 16g. In FIG. 20, therefore, when the sun gear 16a is rotated forward in the direction of arrow n, the latch slot 16g$_1$ of the rotation checking plate 16g is engaged with the latch projection 16 to lock the rotation, and the planetary gears 16b$_1$, 16b$_2$, 16b$_3$ in mesh with the sun gear 16a are rotated about their own axes. On the other hand, when the sun gear 16a is rotated backward, the rotation checking plate 16g is now not subjected to the locking force like above and hence rotated together with the sun gear 16a in the same direction. At this time, the planetary gears 16b$_1$, 16b$_2$, 16b$_3$ are caused to revolve round the sun gear 16a and hence not subjected to torque tending to rotate them about their own axes.

A sensor plate 16r is attached to the lower ends of the planetary shafts 16h in turn mounted to the rotation checking plate 16g. As shown in FIG. 3, the sensor plate 16r has marks 16r$_1$ which are formed by dividing its surface into eight equal sectors. Also, as shown in FIG. 21, a clutch sensor $S_4$ is disposed in a position opposite to the sensor plate 16r.

Next, there will be described the manner of selectively transmitting drive power of the stepping motor 15 to the supply/discharge belt 3c, the platen 4, and other components by the clutch means 16 thus constructed.

In the state as shown FIG. 20, the planetary gear 16b$_1$ is meshed with the platen gear 16c, the planetary gear 16b$_3$ is meshed with the take-up gear 16f, and the remaining planetary gear 16b$_2$ is not meshed with any gear train. Accordingly, when the stepping motor 15 is rotated forward in this state, the sun gear 16a is rotated in the direction of arrow n, but the rotation checking plate 16g is not rotated. Therefore, torque of the sun gear 16a is transmitted to the platen gear 16c and the take-up gear 16f through the planetary gears 16b$_1$, 16b$_3$, so that the torque is transmitted to the platen 4 and the take-up reel 6e through gear trains 16s (FIG. 21) held in mesh with those gears, respectively.

Then, when the stepping motor 15 is rotated backward to turn the rotation checking plate 16g by an angle of 45° in the direction opposite to arrow n from the state of FIG. 20, the planetary gear 16b$_2$ is now meshed with the platen gear 16c and the other planetary gears 16b$_1$, 16b$_3$ are released from their meshed state. Accordingly, when the stepping motor 15 is rotated forward in this state, the torque is transmitted to only the platen 4 through the planetary gear 16b$_2$.

In this way, by driving the stepping motor 15 backward to turn the rotation checking plate 16g in units of 45° successively as mentioned above, it becomes possible to change the meshing states between the planetary gears 16b$_1$, 16b$_2$, 16b$_3$ and the platen gear 16c, the supply/discharge gear 16d and the platen lock gear 16f in sequence. Also, by driving the stepping motor 15 forward, it becomes possible to transmit the torque to those respective gears in mesh with the planetary gears 16b$_1$, 16b$_2$, 16b$_3$ in that state.

Furthermore, in this embodiment, the clutch sensor $S_4$ detects an angular position of the rotation locking plate 16g every time it is turned by an angle of 45°, thereby signalling which one or more driven components such as the platen 4 are set to receive the drive power through the planetary gears 16b$_1$, 16b$_2$, 16b$_3$ at the respective clutch positions (hereinafter referred to as CP). The setting in this embodiment is as follows.

TABLE 2

| CP | Gear(s) meshed with planetary gear(s) |
|---|---|
| 0 | Platen gear |
| 1 | Supply/Discharge gear, Platen gear |
| 2 | Supply/Discharge gear |
| 3 | Platen lock gear, Supply/Discharge gear |

TABLE 2-continued

| CP | Gear(s) meshed with planetary gear(s) |
|---|---|
| 4 | Platen lock gear, |
| 5 | Take-up gear, Platen lock gear |
| 6 | Take-up gear |
| 7 | Platen gear, Take-up gear |

As explained above, by using the clutch means 16 and driving the stepping motor 15 backward, the meshing states between the planetary gears 16$b_1$, 16$b_2$, 16$b_3$ and the driven gears such as the platen gear 16*c* and supply/discharge gear 16*d* can be changed in sequence. Then, by driving the stepping motor 15 forward, the drive power can be selectively transmitted to one or more driven components such as the platen 4.

Accordingly, it is possible to drive the platen 4, the supply/discharge belt 3*c* or the take-up reel 6*e* in a selective manner by using a single motor, and there is no need of providing a separate motor for each of the driven components. As a result, the manufacture cost can be reduced by minimizing the number of motors to be used, while permitting a reduction in space.

Figure 22:
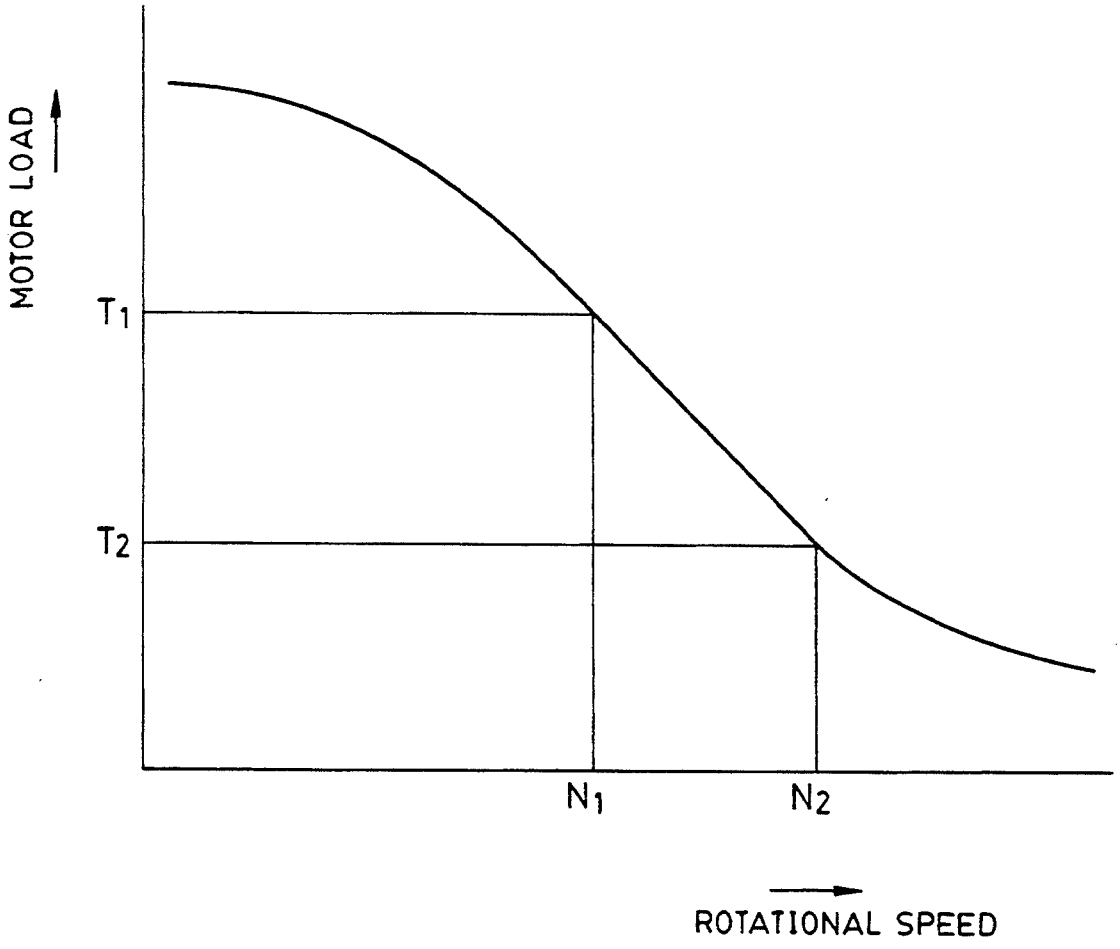
FIG. 22 is a graph showing characteristics between the rotational speed and torque of a stepping motor.

Between the period during backward rotation of the stepping motor 15 (i.e., when the clutch is shifted in its position) and the period during forward rotation thereof (i.e., when the platen 4 and others are driven), there exists a difference in the load exerted on the stepping motor 15; that is, the load during backward rotation is small, while the load during forward rotation is large. Therefore, this embodiment utilizes torque—speed characteristics of the stepping motor 15. As shown in FIG. 22, that torque becomes larger at lower rotational speeds of the stepping motor 15, while torque becomes smaller at higher rotational speeds thereof. In view of such characteristics, during forward rotation of the motor subjected to the larger load, the rotational speed $N_1$ is set smaller to produce larger torque $T_1$. On the contrary, during backward rotation of the motor subjected to the smaller load, the rotational speed $N_2$ is increased to shift clutch positions faster (while producing torque $T_2$ at this time). Thus, the stepping motor 15 is driven while changing the rotational speed between the period during forward rotation and that during backward rotation.

By changing the rotational speed of the stepping motor 15 dependent on fluctuations in the load as explained above, it is not necessary to provide separate motors for respective levels of the load, permitting the single motor 15 to selectively transmit the drive power to the platen 4 and other driven components.

Next, a control system for controlling operation of the aforesaid respective components will be described.

Figure 23:
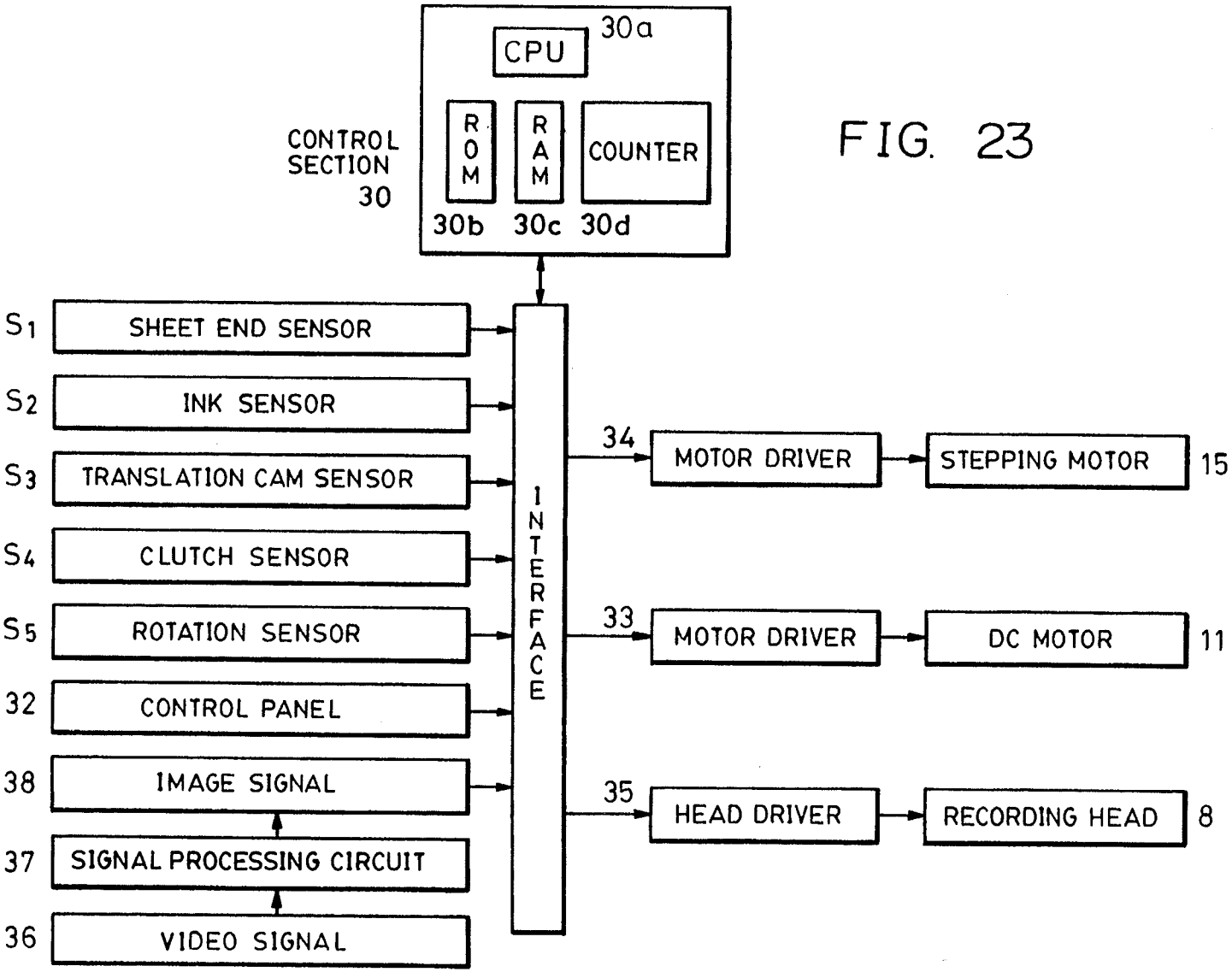
FIG. 23 is a block diagram of a control system.

As shown in FIG. 23, the control system comprises a control section 30 which includes a CPU 30*a* such as a microprocessor, a ROM 30*b* storing therein a control program for the CPU 30*a* and various data, a RAM 30*c* used as a working area of the CPU 30*a*, a counter 30*d* for counting the rotated amount of a motor, for example, an interface 31, a control panel 32, a motor driver 33 for driving a DC motor 11, a motor driver 34 for driving the stepping motor 15, a head driver 35 for driving and heating the recording head 8, and the foregoing respective sensors $S_1$–$S_5$.

The control section 30 receives, via the interface 31, various information from the control panel 32 and signals from the respective sensors $S_1$–$S_5$, as well as an image signal 38 for driving the recording head 8, the image signal 38 being obtained by converting an input video signal 36 through a signal processing circuit 37. The control section 30 also outputs, via the interface 31, a set of motor ON, OFF and forward, backward signals for properly driving the DC motor 11 and the stepping motor 15, as well as an image signal, thereby driving the respective components based on those output signals.

In the recording apparatus of this embodiment, the control panel 32 includes a platen free switch for releasing the coupling between the platen 4 and the clutch means 16 to make the platen 4 free. Thus, when the platen free switch is turned on, the CP (clutch position) of the clutch means 16 is changed to '2' or '6' so that all the planetary gears 16$b_1$, 16$b_2$, 16$b_3$ become disengaged from the platen gear 16*c*. Accordingly, in the event that a jam occurs, or the like, during the recording process, the platen 4 can be made free so as to be rotated by turning on the platen free switch. This allows the operator to freely rotate the platen by his or her hand, with the result that the jam can be cleared easily.

In addition to the above platen free switch, a jam sensor may be provided near the platen 4. In this case, if there occurs a jam, the CP of the clutch means is automatically changed based on a signal issued from the jam sensor.

Next, the operation sequence to be followed to record an image using the recording apparatus thus constituted will be described with reference to the flowcharts of FIGS. 24(A), 24(B), 24(C) and 25.

Figure 24:
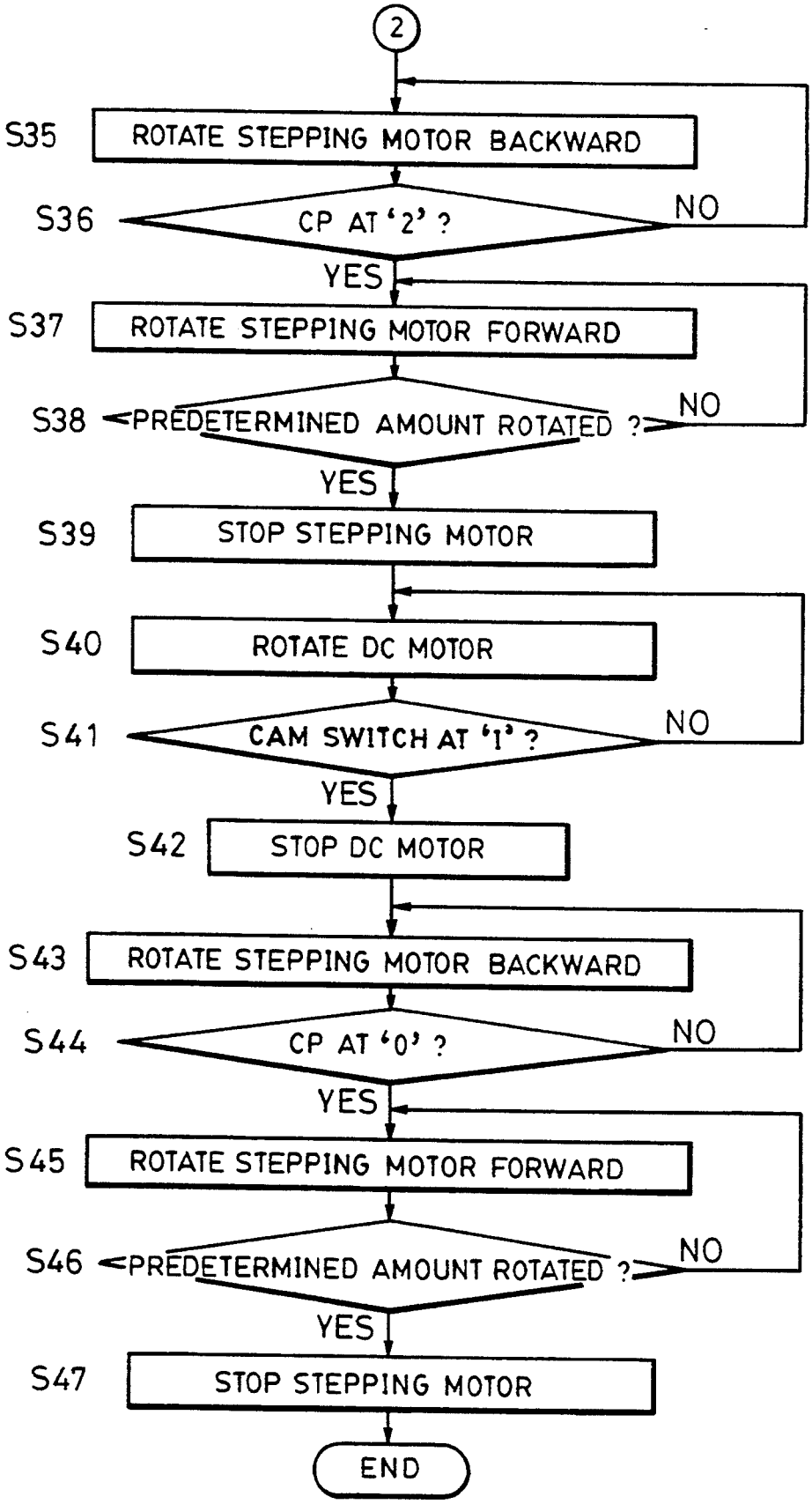
FIGS. 24(A), 24(B), 24(C) and 25 are flowcharts showing the operation sequence.

At the outset, when a recording start signal is applied, the cam switch for the translation cams 13, 14 is set to the position 'I' in Table 1 in step S1 of FIGS. 24(A) and 24(B). In subsequent steps S2, S3, the stepping motor 15 is driven to rotate backward and the CP of the clutch sensor $S_4$ is detected so that the CP is set to the position '0' shown in Table 2 for operating the platen 4 only.

Then, once operation is stopped, the stepping motor 15 is driven to rotate forward until the platen 4, corotatable with the gripper 5, is rotated to an initial position in steps S4, S5. Next, in step S6, the stepping motor 15 is further driven to rotate forward a predetermined amount for turning the platen 4 until the gripper 5 reaches the position shown in FIG. 14(B). Afterward, in steps S7, S8, the stepping motor 15 is driven to rotate backward for changing the CP of the clutch means 16 to '4' to thereby lock the platen 4.

In subsequent steps S9–S11, the DC motor 11 is driven to rotate forward for sliding the translation cams 13, 14 until they are stopped at the position of the switch 'V' using the translation cam sensor $S_3$. At this point, as shown in FIG. 17, the feed plate 3*i* comes into an up state, the separation roller 3*e* presses the recording sheets 1 in the cassette 2 against the supply/discharge belt 3*c*, and the register member 3*j* comes into an up state, causing the press member 3$j_5$ to be tightly contacted with the peripheral surface of the platen 4. Further, the first engagement portion 25$b_1$ of the gripper cam 25 pushes up the cam projection 5$b_6$ of the gripper for opening the gripper 5.

In subsequent steps S12, S13, the stepping motor 15 is driven to rotate backward for changing the CP to '2' so that the drive power is transmitted to the supply/discharge belt 3*c* only. Then, in step S14, the stepping motor 15 is driven to rotate forward, whereupon the supply/discharge belt 3*c* is rotated in the direction of arrow c in FIG. 17(B) to feed the recording sheets 1 while separating them one by one. During the sheet feeding, the sheet end sensor $S_1$ detects the leading end of the recording sheet and the stepping motor 15 is then stopped at the time after feeding of a predetermined amount, in steps S15–S17. The leading end of the recording sheet 1 is thereby brought into abutment with the register member 3*j* to be properly positioned at the sheet end while correcting the skewed feed.

As shown in FIG. 24(B), in subsequent steps S18–S20, the DC motor 11 is driven to rotate backward for sliding the translation cams 13, 14 back to the position of switch 'I'. At this point, the gripper 5 grips the leading end of the recording sheet 1 on the peripheral surface of the platen 4, the feed plate 3*i* comes into a down state, the register member 3*j* comes into a down state, and the discharge lever 9*a* comes into an up state.

In subsequent steps S21, S22, the stepping motor 15 is driven to rotate backward for changing the CP of the clutch means 16 to '0'. Recording is then performed in step S23.

Figure 25:
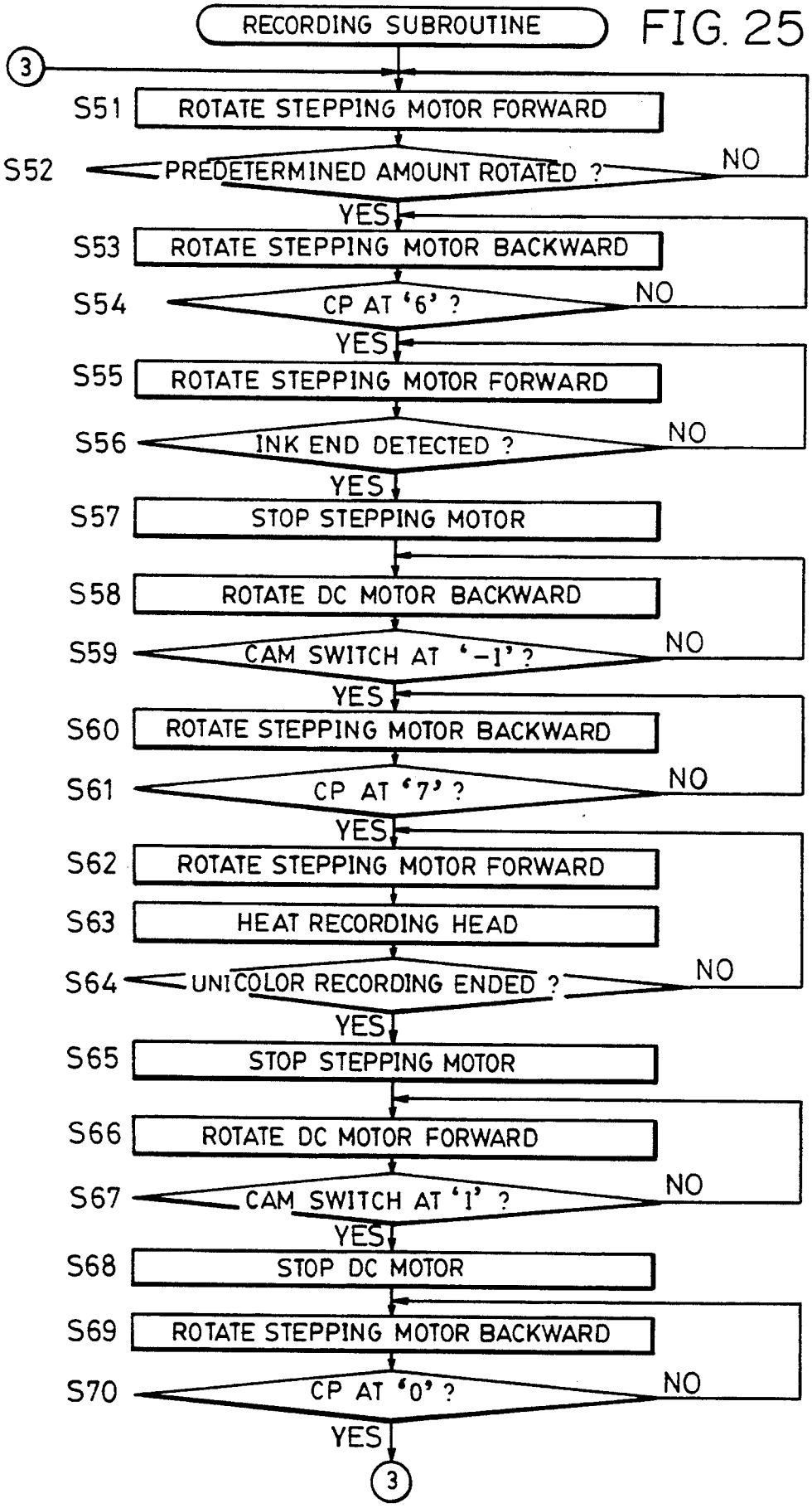

Assuming here that the recording subroutine performs color recording in the order of yellow, magenta and cyan, as shown in FIG. 25, the stepping motor 15 is driven to rotate forward for turning the platen 4 a predetermined amount, so that the leading end of the recording sheet 1 is fed to a predetermined position for being queued or prepared for recording, in steps S51, S52.

In subsequent steps S53, S54, the stepping motor 15 is driven to rotate backward for changing the CP of the clutch means 16 to '6' to thereby mesh the the planetary gear with the take-up gear 16*e*. Afterward, in steps S55–S57, the stepping motor 15 is driven to rotate forward, causing the ink sheet 7 to be taken up by the take-up reel 6*e* until the ink sensor $S_2$ detects the end mark 7*a* of yellow Y region on the ink sheet 7, so that the ink sheet 7 is queued for recording.

In subsequent steps S58, S59, the DC motor 11 is driven to rotate backward for turning the rotating cams 12 to the switch '—I' using the rotation sensor $S_5$, whereby the recording head 8 is brought into a head-down state.

In subsequent steps S60–S65, the stepping motor 15 is driven to rotate forward for changing the CP of the clutch means 16 to '7' to thereby mesh the planetary gears with the platen gear 16*c* and the take-up gear 16*e*. Afterward, the stepping motor 15 is driven to rotate forward for turning the platen 4 and the take-up reel 6*e* in the directions a, g in FIG. 2(B), respectively, so that the recording sheet 1 and the ink sheet 7 are fed together in a pressure contact condition therebetween. Simultaneously, the heating elements of the recording head 8 are heated in accordance with the image signal to first make yellow recording.

After completion of the yellow recording, the DC motor 11 is driven to rotate forward for turning the rotating cams 12 to the position of switch 'I' to thereby bring the recording head 8 into a head-up state. Then, in steps S69, S70, the stepping motor 15 is driven to rotate backward for changing the CP of the clutch means 16 to '0' to thereby mesh the planetary gear with the platen gear 16*c* and the take-up gear 16*e*.

Next, after returning to the step S51, the above process is repeated to perform magenta recording and cyan recording in a like manner.

Through the above recording subroutine, color recording of yellow, magenta and cyan is made on the recording sheet 1 successively.

After completion of the recording of all colors as mentioned above, the control sequence goes to steps S24–S26 shown in FIG. 24(B) where the DC motor 11 is driven to rotate forward for sliding the translation cams 13, 14 to the position of switch 'II'. The discharge lever 9*a* is thereby brought into a down state.

Figure 18:
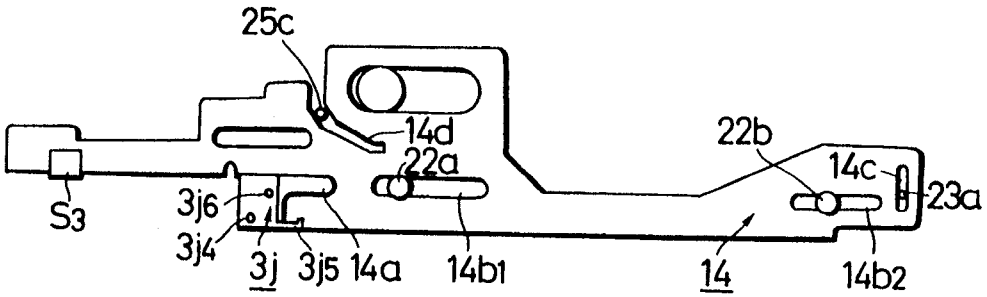
Figure 18:
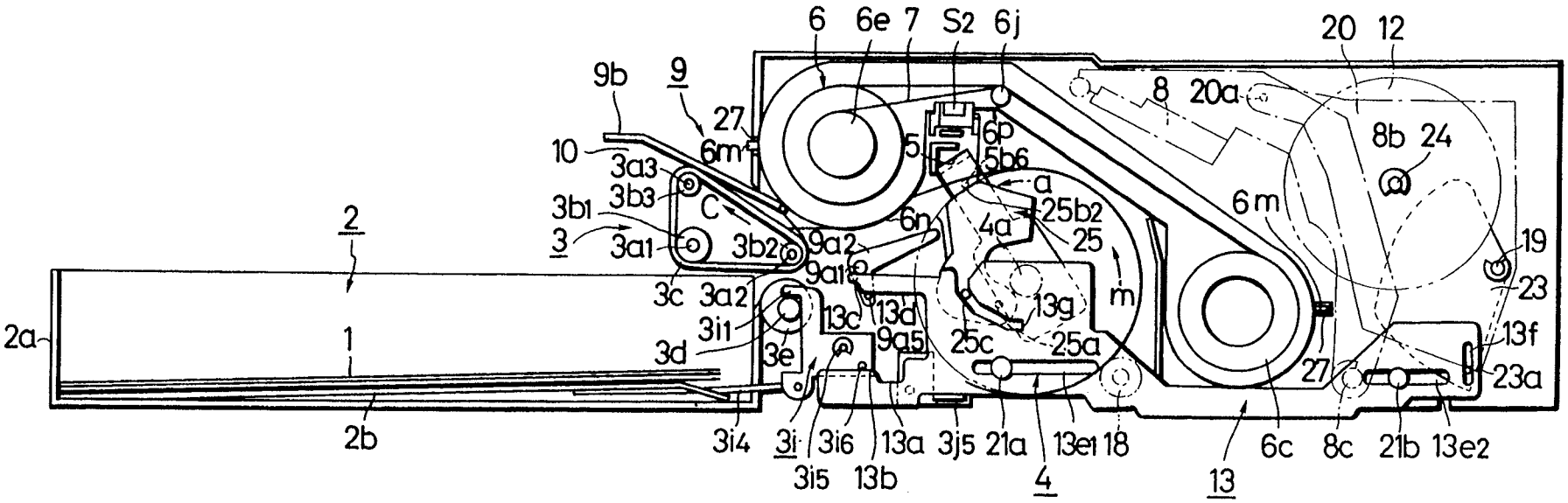
Figure 19:
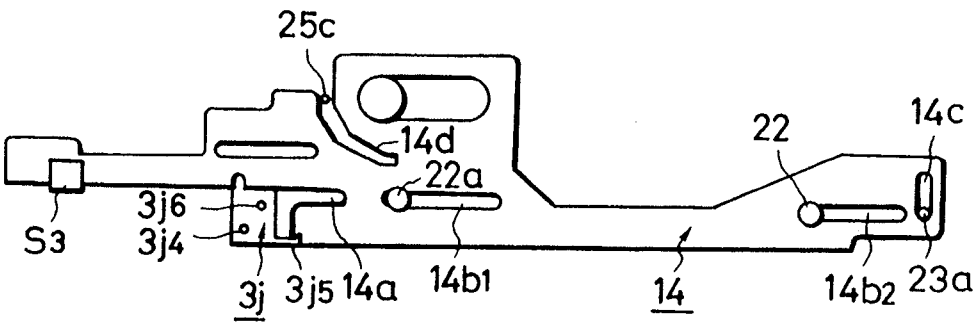
Figure 19:
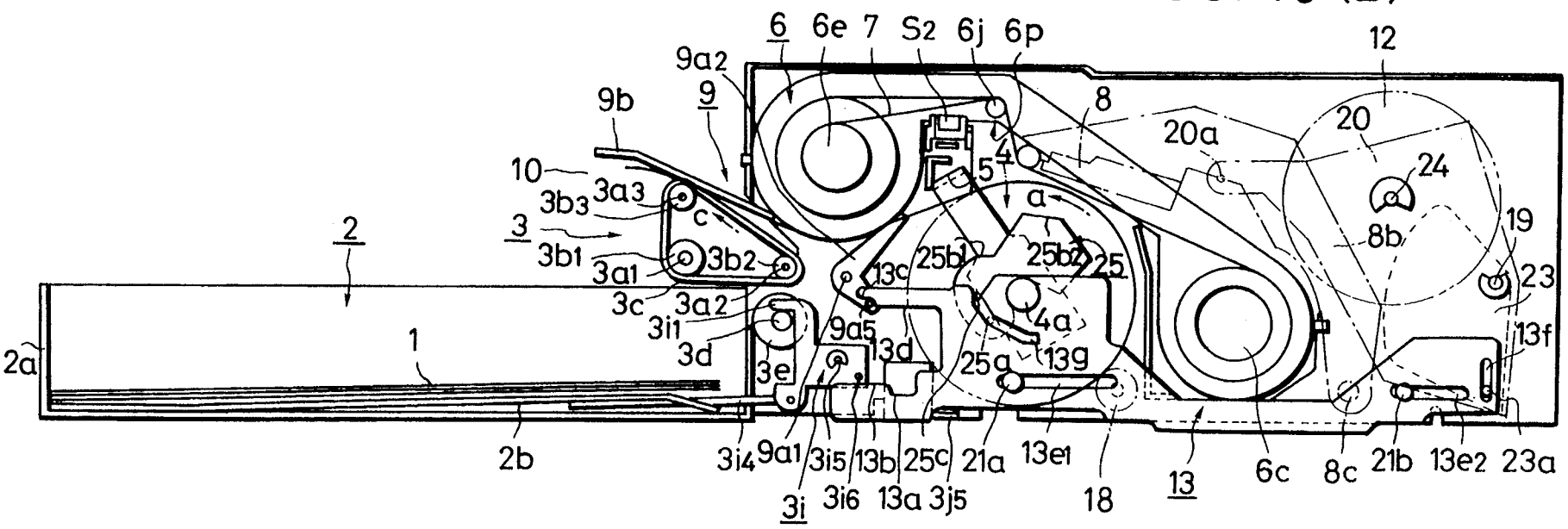

In subsequent steps S27, S28, the stepping motor 15 is driven to rotate backward for changing the CP of the clutch means 16 to '1'. Then, in steps S29, S30, the stepping motor 15 is driven to rotate forward for turning the platen 4 and the supply/discharge belt 3*c*. At this time, when the gripper 5 of the platen 4 is rotated to a predetermined position, the cam projections $5b_6$ ride over the second engagement portions $25b_2$ of the gripper cam 25 as shown in FIGS. 18(A) and 18(B). The recording sheet 1 is thereby released from a gripped state by the gripper 5. When the platen 4 is further rotated, the lock projections $5b_4$ of the gripper 5 is engaged with the circular grooves 4*b* of the platen 4 for holding the recording sheet in a state released from the gripper, as shown in FIG. 7(B). After that, therefore, only the platen 4 is rotated with the gripper 5 remaining as before.

The recording sheet 1 thus released at its leading end from a gripped state by the gripper 5 is now fed under cooperation of the platen 4 and the pinch roller 18 for being discharged. At this time, as shown in FIGS. 18(A) and 18(B), the leading end of the recording sheet 1 is guided by the guide portion 6*n* on the lower surface of the ink sheet cassette 6 and then led to the discharge port 10 by the discharge lever 9*a*. As mentioned above, since the ink sheet cassette 6 doubles as a sheet guide during discharge of the recording sheet 1 in this embodiment, there is no need of providing, near the platen 4, a guide member adapted to guide the upper surface of the recording sheet 1. As a result, the number of parts can be reduced to achieve a reduction in the manufacture cost of the apparatus, and the installation space can be reduced to permit a smaller size of the apparatus.

During discharge of the recording sheet, after the leading end of the recording sheet 1 has been guided to the discharge side by the discharge lever 9*a*, the DC motor 11 is driven to rotate a predetermined amount (based on time control) for turning the rotating cams 12 by a certain angle in steps S31–S33. Thus, as shown in FIGS. 9(A) and 9(B), the recording head 8 is lowered to an intermediate position between an up state and a down state. When the platen 4 is rotated under this condition, the recording sheet 1 released at its leading end from a gripped state by the gripper 5 is held against the platen and discharged without causing slack.

In other words, during the discharge process, the recording head 8 and the ink sheet cassette 6 function as guide member for the recording sheet 1. This ensures sure discharge of the recording sheet 1, without the need for providing special guide members around the platen 4.

Afterward, in step S34, the stepping motor 15 is driven to feed the recording sheet 1 through a predetermined distance. When the leading end of the recording sheet 1 reaches the supply/discharge belt 3*c*, the stepping motor 15 is driven to rotate backward for changing the CP of the clutch means 16 to '2' in steps S35, S36 as shown in FIG. 24(C). Then, in steps S37–S39, the stepping motor 15 is driven to rotate forward for turning only the supply/discharge belt 3*c*, whereby the recording sheet 1 is discharged under cooperation of the supply/discharge belt 3*c* and the guide member 9*b* tightly contacted with the belt 3*c* by its dead load.

After the recording sheet 1 has been discharged as mentioned above, the DC motor 11 is driven to rotate forward for sliding the translation cams 13, 14 to the position of switch 'I' in steps S40–S42. Then, in steps S43, S44, the stepping motor 15 is driven to rotate backward for changing the CP of the clutch means 16 to '0'. When the platen 4 is thereby rotated to a predetermined position, the lock projections $5b_4$ are dropped into the lock grooves $4b_1$ of the platen 4 by the tension spring 5c of the gripper 5 so that the gripper 5 and the platen 4 are now rotated together. The recording operation is thus terminated.

If a jam occurs during the recording operation, the platen 4 can be made free by turning on the aforesaid platen free switch.

With this embodiment constituted as mentioned above, color recording can be performed in accordance with the image signal from video equipment and the like using the recording apparatus of reduced size.

Although the above embodiment has been explained by taking the video signal as an example of an image signal, it should be understood that the image signal may also be a read-out signal or an output signal from computers, for instance.

In short, with this invention, the recording head selectively heats the ink sheet in accordance with the image signal to record a predetermined image on the recording sheet during the time when the recording sheet is being fed by the feed means.

When loading the ink sheet cassette and recording the predetermined image, since the ink sheet cassette doubles as a sheet guide without the need for providing a special sheet guide, the number of parts can be minimized for a reduction in the manufacture cost as well as the apparatus size.

As described above, the present invention can provide an ink sheet cassette which makes it possible to reduce the body size of the recording apparatus, and a recording apparatus which can load that ink sheet cassette therein.

What is claimed is:

1. An ink sheet cassette loadable in a recording apparatus, said ink sheet cassette comprising:

an ink sheet having an ink layer surface;

first winding means for winding said ink sheet;

second winding means for winding said ink sheet; and a bent frame to which are attached said first winding means and said second winding means, said frame having a first leg and a second leg meeting said first leg at an intersection and thereby defining a bent ink sheet path within said legs such that when said ink sheet cassette is not loaded in said recording apparatus, said ink sheet extends from said first winding means along a first plane in said first leg, bends only once at said intersection when said ink sheet is fullytensioned, and extends along a second plane in said second leg to said second winding means, said frame further comprising;

guiding means for guiding feeding of a recording medium when said ink sheet cassette is loaded in the recording apparatus, said frame being bent orthogonally with respect to said ink layer surface.

2. An ink sheet cassette according to claim 1, wherein said frame comprises a container including a container body and a cover member fitted to each other.

3. An ink sheet cassette according to claim 1, further comprising a press spring for biasing said first winding means;

a lock projection; and a lock groove, said press spring causing said lock projection to engage with said lock groove so that said ink sheet cassette may be prevented from rotating.

4. An ink sheet cassette according to claim 1, further comprising a press spring for biasing said second winding means;

a lock projection; and a lock groove, said press spring causing said lock projection to engage with said lock groove so that said ink sheet cassette may be prevented from rotating during removal.

5. An ink sheet cassette according to claim 3, wherein said lock projection is disengaged from said lock groove allowing said first winding means to rotate when said ink sheet cassette is loaded in said recording apparatus.

6. An ink sheet cassette according to claim 4, wherein said lock projection is disengaged from said lock groove allowing said second winding means to rotate when said ink sheet cassette is loaded in said recording apparatus.

7. An ink sheet cassette according to claim 1, wherein said frame has a plurality of openings through which a recording medium and a recording head provided on a body side of said recording apparatus contact said ink sheet, when said ink sheet cassette is loaded in said recording apparatus.

8. An ink sheet cassette according to claim 1, wherein said frame further comprises a container comprising a container body and a cover member, each of said container body and said cover member having an opening formed therein and wherein a recording head provided on a body side of the recording apparatus enters through the opening in said cover member when said ink sheet cassette is loaded in said recording apparatus, such that said ink layer surface on said ink sheet contacts a recording medium through the opening formed in said container body.

9. A recording apparatus for recording an image on a recording medium, said recording apparatus comprising:

loading means for detachably loading an ink sheet cassette having an ink sheet having an ink layer surface, said ink sheet cassette, said ink sheet cassette further comprising;

first winding means for winding said ink sheet;

second winding means for winding said ink sheet, said first winding means and said second winding means being disposed in a first plane; and a bent frame to which are attached said first winding means and said second winding means, said frame having a first leg and a second leg meeting said first leg at an intersection and thereby defining a bent ink sheet path within said legs such that when said ink sheet cassette is not loaded in said recording apparatus, said ink sheet extends from said first winding means along said first plane in said first leg, bends only once, and extends along a second plane in said second leg to said second winding means, said frame further comprising;

guiding means for guiding feeding of the recording medium when said ink sheet cassette is loaded in said recording apparatus, said frame being bent orthogonally with respect to said ink layer surface;

recording means for recording an image on the recording medium by acting upon said ink sheet of said ink sheet cassette loaded in said loading means; and feeding means for feeding the recording medium.

10. A recording apparatus according to claim 9, wherein said recording means comprises a thermal head having a plurality of heating elements.

11. An ink sheet cassette loadable in a recording apparatus body comprising:

supply means for supplying an ink sheet;

take-up means for taking up said ink sheet supplied from said supply means, said supply means and said take-up means being disposed in a first plane;

bent containing means for containing said supply means and said take-up means, said containing means having a first leg and a second leg meeting said first leg at an intersection and thereby defining a bent ink sheet path within said legs such that when said ink sheet cassette is not loaded in said recording apparatus, said ink sheet extends from said supply means along said first plane in said first leg, bends only once, and extends along a second plane in said second leg to said take-up means; and guiding means for guiding feeding of a recording sheet when said ink sheet cassette is loaded in the apparatus body.

12. A recording apparatus for recording an image on a recording sheet by selectively heating an ink sheet, said recording apparatus comprising:

feeding means for feeding said recording sheet;

recording means for selectively heating said ink sheet in accordance with an image signal to record said image;

a bent ink sheet cassette containing said ink sheet and having a first leg and a second leg meeting said first leg at an intersection and thereby defining a bent ink sheet path within said legs such that when said ink sheet cassette is not loaded in said recording apparatus, said ink sheet extends along a first plane in said first leg, bends only once, and extends along a second plane in said second leg, said ink sheet cassette further comprising recording sheet guiding means for guiding said recording sheet; and cassette loading means for removably loading said ink sheet cassette.

13. A recording apparatus for recording on a recording sheet, comprising:

loading means for detachably loading an ink sheet cassette;

said ink sheet cassette, said ink sheet cassette further comprising supply means for supplying an ink sheet, take-up means for taking up the ink sheet and bent containing means for containing said supply means and said take-up means, said bent containing means having a first leg and a second leg meeting said first leg at an intersection and thereby defining a bent ink sheet path within said legs such that when said ink sheet cassette is not loaded in said recording apparatus, said ink sheet extends from said supply means along a first plane in said first leg, bends only once, and extends along a second plane in said second leg to said take-up means, and having guiding means for guiding feeding of said recording sheet when said ink sheet cassette is loaded in the apparatus body;

recording means for recording said ink sheet by heating said ink sheet contained in said ink sheet cassette in accordance with an image signal; and feeding means for feeding said recording sheet, to which ink on said ink sheet is transferred, when heated by said recording means.

14. An ink sheet cassette for use in a recording apparatus, comprising:

a first winding means receiving portion which contains a first winding means for winding an ink sheet having an ink layer surface, said first winding means receiving portion having an opening for guiding feeding of the ink sheet;

a second winding means receiving portion which contains a second winding means for winding said ink sheet, said second winding means receiving portion having an opening for guiding feeding of the ink sheet; and a bent frame having an opening portion, said first winding means receiving portion and said second winding means receiving portion being attached to said frame, said opening portion being dimensioned and disposed so that said ink sheet is suitably exposed to be acted upon for recording, said frame having a first leg and a second leg meeting said first leg at an intersection and thereby defining a bent ink sheet path within said legs such that when said ink sheet cassette is not loaded in said recording apparatus, said ink sheet extends from said first winding means along a first plane in said first leg, bends only once, and extends along a second plane in said second leg to said second winding means.

15. An ink sheet cassette according to claim 14, wherein said frame further comprises a container having a container body and a cover member fitted to each other and in which said first and said second winding means receiving portions are formed.

16. An ink sheet cassette according to claim 14, further comprising;

a lock projection;

a lock groove; and a press spring for biasing said first winding means and for engaging said lock projection with said lock groove so that said ink sheet cassette may be prevented from rotating.

17. An ink sheet cassette according to claim 14, further comprising;

a lock projection;

a lock groove; and a press spring for biasing said second winding means and for engaging said lock projection with said lock groove so that said ink sheet cassette may be prevented from rotating during removal.

18. An ink sheet cassette according to claim 16, wherein said lock projection is disengaged from said lock groove allowing said first winding means to rotate when said ink sheet cassette is loaded in said recording apparatus.

19. An ink sheet cassette according to claim 17, wherein said lock projection is disengaged from said lock groove allowing said second winding means to rotate when said ink sheet cassette is loaded in said recording apparatus.

20. An ink sheet cassette according to claim 14, wherein said frame has a plurality of openings through which a recording medium and a recording head provided on a body side of a recording apparatus contact said ink sheet, when said ink sheet cassette is loaded in the recording apparatus.

21. An ink sheet cassette according to claim 14, wherein said frame further comprises a container comprising a container body and a cover member, each of said container body and said cover member having an opening formed therein and wherein a recording head provided on a body side of a recording apparatus enters through the opening in said cover member when said ink sheet cassette is loaded in said recording apparatus, such that said ink layer surface on said ink sheet contacts a recording medium through the opening formed in said container body, and in which said first and said second winding means receiving portions are formed in said container.

22. A recording apparatus for recording an image on a recording medium, said recording apparatus comprising:

recording means for recording an image on said recording medium;

feeding means for feeding said recording medium;

loading means for detachably loading an ink sheet cassette, said ink sheet cassette comprising a first winding means receiving portion containing a first winding means for winding an ink sheet and having an opening for guiding feeding of said ink sheet, a second winding means receiving portion containing a second winding means for winding said ink sheet and having an opening for guiding feeding of said ink sheet, said ink sheet cassette having an opening portion which opening portion is dimensioned and disposed so that said ink sheet is suitably exposed to be acted upon for recording, and a bent frame to which said first and said second winding means receiving portions are attached, said frame having a first leg and a second leg meeting said first leg at an intersection and thereby defining a bent ink sheet path within said legs such that when said ink sheet cassette is not loaded in said recording apparatus, said ink sheet extends from said first winding means along a first plane in said first leg, bends only once, and extends along a second plane in said second leg to said second winding means.

23. A recording apparatus according to claim 22, wherein said frame further comprises a container having a container body and a cover member fitted to each other and in which said first and said second winding means receiving portions are formed.

24. A recording apparatus according to claim 22, further comprising a press spring for biasing said first winding means;

a lock projection; and a lock groove, said press spring causing said lock projection to engage with said lock groove so that said ink sheet cassette may be prevented from rotating.

25. A recording apparatus according to claim 22, further comprising a press spring for biasing said second winding means;

a lock projection; and a lock groove, said press spring causing said lock projection to engage with said lock groove so that said ink sheet cassette may be prevented from rotating during removal.

26. A recording apparatus according to claim 24, wherein said lock projection is disengaged from said lock groove allowing said first winding means to rotate when said ink sheet cassette is loaded in said recording apparatus.

27. A recording apparatus according to claim 25, wherein said lock projection is disengaged from said lock groove allowing said second winding means to rotate when said ink sheet cassette is loaded in said recording apparatus.

28. A recording apparatus according to claim 22, wherein said frame has a plurality of openings through which a recording medium and a recording head provided on a body side of said recording apparatus contact said ink sheet, when said ink sheet cassette is loaded in said recording apparatus.

29. A recording apparatus according to claim 22, wherein said frame further comprises a container body and a cover member, each of said container body and said cover member having an opening formed therein and wherein a recording head provided on a body side of said recording apparatus enters through the opening formed in said cover member when said ink sheet cassette is loaded in said recording apparatus, such that an ink layer surface on said ink sheet contacts said recording medium through the opening formed in said container body, and in which said first and said second winding means receiving portions are formed in said container.

30. A recording apparatus according to claim 22, wherein said recording means comprises a thermal head having a plurality of heating elements.

31. An ink sheet cassette loadable in a recording apparatus, said ink sheet cassette comprising:

an ink sheet having an ink layer surface;

first winding means for winding said ink sheet;

second winding means for winding said ink sheet; and a bent frame to which are attached said first winding means and said second winding means, said frame having a first leg and a second leg meeting said first leg at an intersection and thereby defining a bent ink sheet path within said legs such that when said ink sheet cassette is not loaded in said recording apparatus, said ink sheet extends from said first winding means along a first plane in said first leg, bends only once at said intersection when said ink sheet is fully-tensioned, and extends along a second plane in said second leg to said second winding means.

32. A recording apparatus for recording an image on a recording medium, said recording apparatus comprising:

loading means for detachably loading an ink sheet cassette having an ink sheet having an ink layer surface, said ink sheet cassette, said ink sheet cassette further comprising;

first winding means for winding said ink sheet;

second winding means for winding said ink sheet, said first winding means and said second winding means being disposed in a first plane; and a bent frame to which are attached said first winding means and said second winding means, said frame having a first leg and a second leg meeting said first leg at an intersection and thereby defining a bent ink sheet path within said legs such that when said ink sheet cassette is not loaded in said recording apparatus, said ink sheet extends from said first winding means along said first plane in said first leg, bends only once, and extends along a second plane in said second leg to said second winding means;

recording means for recording an image on the recording medium by acting upon said ink sheet of said ink sheet cassette loaded in said loading means; and feeding means for feeding the recording medium.

* * * * *

UNITED STATES PATENT AND TRADEMARK OFFICE

CERTIFICATE OF CORRECTION

PATENT NO. : 5,352,048

DATED : October 4, 1994

INVENTOR(S) : Mizoguchi et al

It is certified that error appears in the above-indentified patent and that said Letters Patent is hereby corrected as shown below:

ON TITLE PAGE

In [56] REFERENCES CITED,
U.S. PATENT DOCUMENTS, line 9, "Casta et al." should read --Costa et al.--.

COLUMN 4

Line 36, "tnsile" should read --tensile--.
Line 47, "the the" should read --the--.

COLUMN 8

Line 15, "8b" should read --8--.

COLUMN 9

Line 24, "ridges 6" should read --ridges 6m--.
Line 44, "from from" should read --from--.

COLUMN 10

Line 21, "wail" should read --wall--.

COLUMN 12

Line 5, "equi-distantly" should read --equidistantly--.

COLUMN 13

Line 14, "5b6" should read --5b$_6$--.
Line 38, "2(B)) should read --2(B)):--.
Line 65, "14(B)) should read --14(B)):--.

UNITED STATES PATENT AND TRADEMARK OFFICE

CERTIFICATE OF CORRECTION

PATENT NO. : 5,352,048

DATED : October 4, 1994

INVENTOR(S) : Mizoguchi et al

It is certified that error appears in the above-indentified patent and that said Letters Patent is hereby corrected as shown below:

COLUMN 14

Line 1, "Regist" should read --Register--.
Line 14, "15(B))" should read --15(B)):--.
Line 28, "case the" should read --the case--.

COLUMN 15

Line 41, "16" should read --161--.
Line 45, "arch projection 16" should read --latch projection 161--.
Line 68, "16" should read --161--.

COLUMN 19

Line 29, "the the" should read --the--.

COLUMN 21

Line 56, "fullytensioned" should read --fully tensioned--.
Line 58, "comprising;" should read --comprising--.

COLUMN 22

Line 47, "comprising;" should read --comprising:--.
Line 62, "comprising;" should read --comprising--.

COLUMN 24

Line 36, "comprising;" should read --comprising:--.
Line 44, "comprising;" should read --comprising:--.

UNITED STATES PATENT AND TRADEMARK OFFICE

CERTIFICATE OF CORRECTION

PATENT NO. : 5,352,048

DATED : October 4, 1994

INVENTOR(S) : Mizoguchi et al

It is certified that error appears in the above-indentified patent and that said Letters Patent is hereby corrected as shown below:

COLUMN 26

Line 47, "comprising;" should read --comprising:--.

Signed and Sealed this

Twenty-fifth Day of April, 1995

Bruce Lehman

*Attest:*

BRUCE LEHMAN

*Attesting Officer*

*Commissioner of Patents and Trademarks*